US006575719B2

(12) United States Patent
Manner et al.

(10) Patent No.: US 6,575,719 B2
(45) Date of Patent: Jun. 10, 2003

(54) PLANETARY ROTARY MACHINE USING APERTURES, VOLUTES AND CONTINUOUS CARBON FIBER REINFORCED PEEK SEALS

(76) Inventors: David B. Manner, 14578 Pyatt Rd., Traverse City, MI (US) 49686; Kevin R. Kirtley, 19 Heather Dr., Clifton Park, NY (US) 12065; Brooke Schumm, III, 2813 Thornbrook Rd., Ellicott City, MD (US) 21042

( * ) Notice: Subject to any disclaimer, the term of this patent is extended or adjusted under 35 U.S.C. 154(b) by 0 days.

(21) Appl. No.: 09/916,561

(22) Filed: Jul. 27, 2001

(65) Prior Publication Data

US 2002/0028151 A1 Mar. 7, 2002

Related U.S. Application Data

(60) Provisional application No. 60/221,263, filed on Jul. 27, 2000.

(51) Int. Cl.[7] ..... F03C 2/00

(52) U.S. Cl. ..... 418/61.2; 418/183; 418/186; 418/123

(58) Field of Search ..... 418/61.2, 186, 418/123, 183

(56) References Cited

U.S. PATENT DOCUMENTS

| | | | | |
|---|---|---|---|---|
| 2,989,951 A | | 6/1961 | Charlson | |
| 2,988,008 A | | 10/1961 | Wankel | |
| 3,221,664 A | | 12/1965 | Jernaes | |
| 3,233,524 A | | 2/1966 | Charlson | |
| 3,424,135 A | * | 1/1969 | Tado | 418/61.2 |
| 3,762,842 A | * | 10/1973 | George, Jr. | 418/61.2 |
| 3,796,525 A | | 3/1974 | Kilmer | |
| 3,860,365 A | * | 1/1975 | Bibbens | 418/61.2 |

(List continued on next page.)

FOREIGN PATENT DOCUMENTS

| | | |
|---|---|---|
| GB | 583035 | 1/1947 |
| GB | 2074247 | 10/1981 |

OTHER PUBLICATIONS

Walker G. et al(pp. 74–81) The Stirling Alternative: Power Systems, Refrigerants and Heat Pumps, Gordon and Breach Science Publishers, Yverdon, Switzerland1994.

(List continued on next page.)

*Primary Examiner*—Thomas Denion
*Assistant Examiner*—Theresa Trieu
(74) *Attorney, Agent, or Firm*—Brooke Schumm, III; Daneker, McIntire, Schumm et al.

(57) ABSTRACT

Apertures through each face of a planetary rotor, volutes for low loss delivery and collection of fluid to and from the working volumes of a planetary rotary pump, compressor, or turbine, and zero clearance seals by using continuous carbon fiber reinforced polyetheretherketone (PEEK) or other self-lubricating materials significantly improve the volumetric flow rate of such rotary pumps compressors or turbines.

Figure 1:
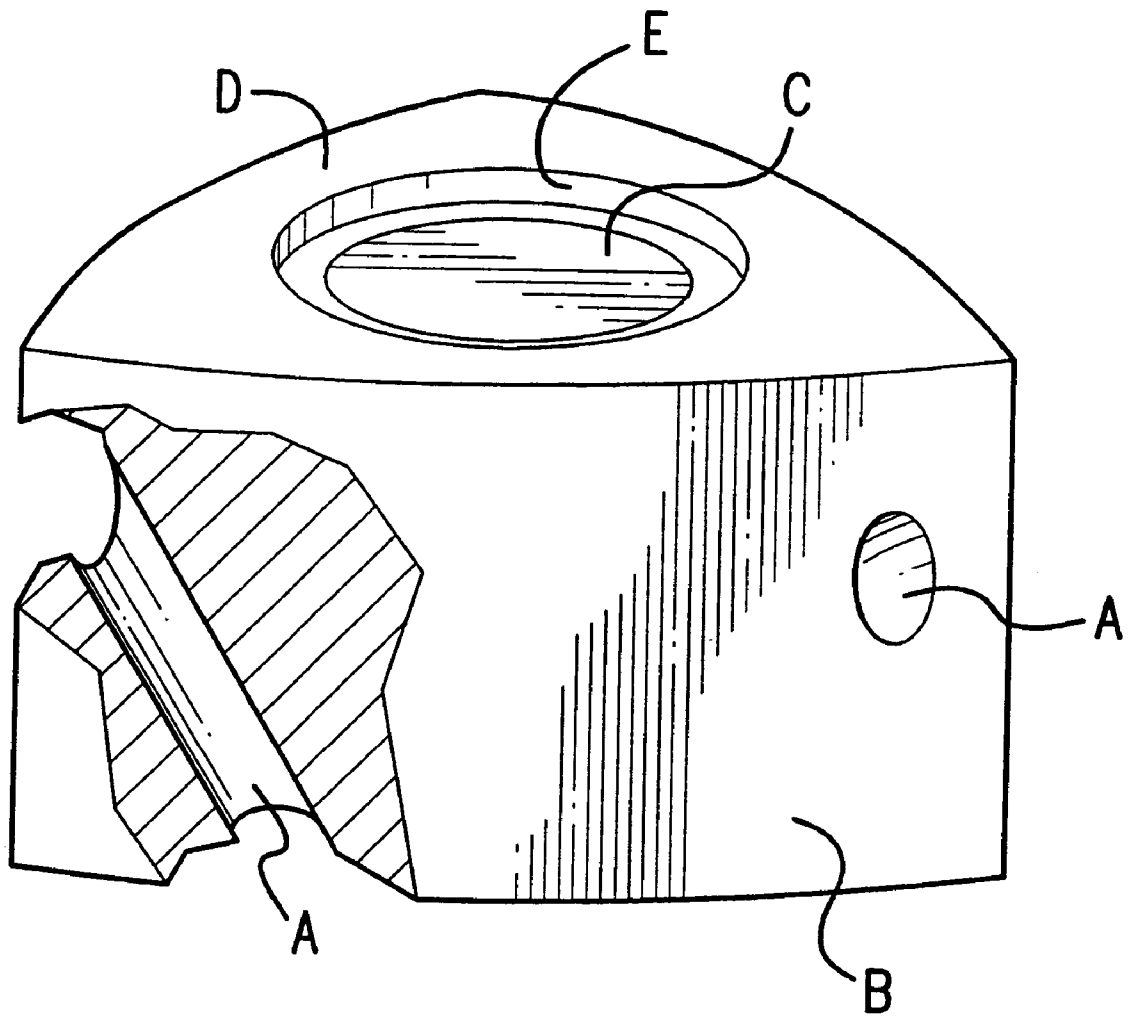
Figure 1B:
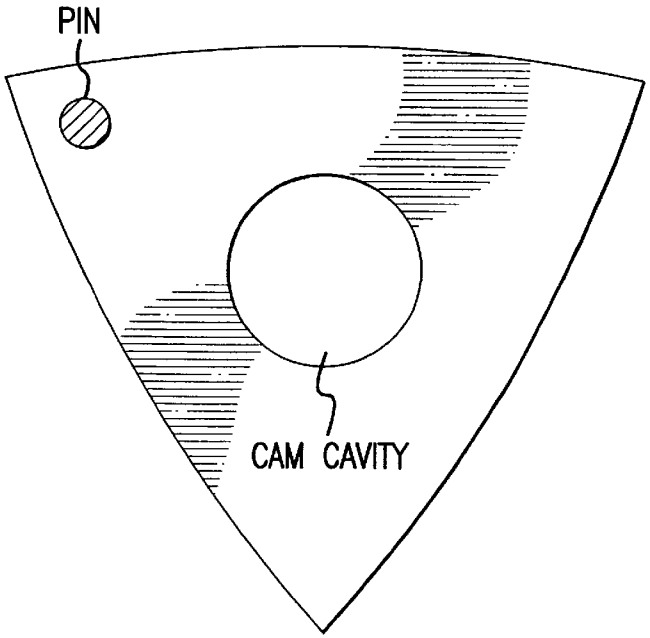
Figure 1A:
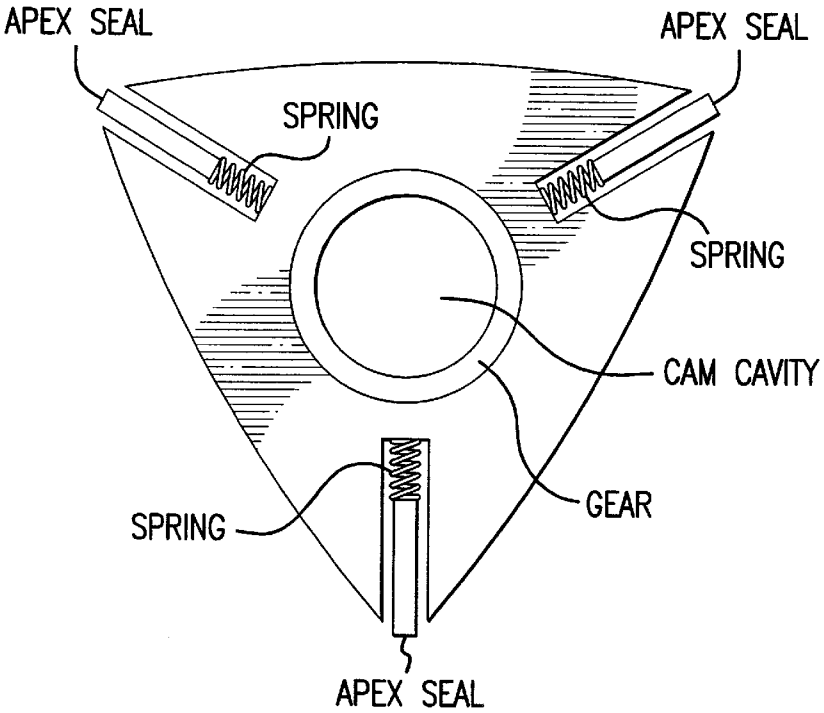

By establishing a means to vent each working volume to an intake or exhaust port at arbitrary rotor positions, apertures linking working volumes to intake or exhaust ports allows each working volume of a multilobe planetary rotary pump to function independently near peak volumetric efficiency. An additional means to improve the performance of planetary rotary pumps has been established by using scroll-like volutes which collect and deliver the exhaust and intake flow for each working volume in a manner which reduces the fluid dynamic loss associated with conventional sudden expansions and contractions found at the inlet and exit of a plenum. To minimize leakage between the separate working volumes and improve performance, self lubricated continuous carbon fiber reinforced polyetheretherketone seals are employed for components in high speed sliding contact. The continuous carbon fiber reinforced PEEK can withstand high sliding speeds, high temperatures with low wear and excellent foreign object impact resistance.

60 Claims, 6 Drawing Sheets

U.S. PATENT DOCUMENTS

| | | | | | |
|---|---|---|---|---|---|
| 3,869,863 | A | | 3/1975 | Juge | |
| 3,872,838 | A | | 3/1975 | Vogelsang | |
| 3,985,476 | A | | 10/1976 | Hofauer | |
| 3,996,901 | A | | 12/1976 | Gale | |
| 3,998,054 | A | | 12/1976 | Whitestone | |
| 4,097,205 | A | | 6/1978 | Miles | |
| 4,345,885 | A | * | 8/1982 | Turner | 418/90 |
| 4,345,886 | A | | 8/1982 | Nakayama et al. | |
| 4,502,855 | A | | 3/1985 | Petersen | |
| 4,669,736 | A | | 6/1987 | Meijer | |
| 4,707,990 | A | | 11/1987 | Meijer | |
| 4,753,073 | A | | 6/1988 | Chandler | |
| 4,772,185 | A | | 9/1988 | Hertell | |
| 4,804,317 | A | | 2/1989 | Smart | |
| 4,820,140 | A | | 4/1989 | Bishop | |
| 4,836,094 | A | | 6/1989 | Meijer | |
| 4,872,819 | A | | 10/1989 | White, Jr. | |
| 4,885,980 | A | | 12/1989 | Meijer | |
| 4,977,742 | A | | 12/1990 | Meijer | |
| 4,984,432 | A | | 1/1991 | Corey | |
| 4,986,739 | A | | 1/1991 | Child | |
| 4,994,004 | A | | 2/1991 | Meijer | |
| 5,027,602 | A | | 7/1991 | Glen | |
| 5,038,580 | A | | 8/1991 | Hart | |
| 5,083,605 | A | | 1/1992 | Collings | |
| 5,114,324 | A | | 5/1992 | Spindeldreher | |
| 5,131,818 | A | | 7/1992 | Wittkop | |
| 5,181,844 | A | | 1/1993 | Bishop | |
| 5,211,017 | A | | 5/1993 | Pusic | |
| 5,211,611 | A | | 5/1993 | Lammers | |
| 5,259,739 | A | | 11/1993 | Coates | |
| 5,305,721 | A | * | 4/1994 | Burtis | 123/205 |
| 5,336,059 | A | | 8/1994 | Rowley | |
| 5,370,508 | A | | 12/1994 | Barthod | |
| 5,399,078 | A | | 3/1995 | Kuramasu | |
| 5,431,551 | A | | 7/1995 | Aquino | |
| 5,541,149 | A | | 7/1996 | Atwater | |
| 5,590,528 | A | | 1/1997 | Viteri | |
| 5,611,201 | A | | 3/1997 | Houtman | |
| 5,624,248 | A | | 4/1997 | Kassen | |
| 5,660,535 | A | | 8/1997 | Kobus | |
| 5,706,659 | A | | 1/1998 | Houtman | |
| 5,722,239 | A | | 3/1998 | Houtman | |
| 5,750,620 | A | | 5/1998 | Davies | |
| 5,765,377 | A | | 6/1998 | Kim | |
| 5,771,694 | A | | 6/1998 | Houtman | |
| 5,782,084 | A | | 7/1998 | Jarvis | |
| 5,813,229 | A | | 9/1998 | Gaiser | |
| 5,813,235 | A | | 9/1998 | Peterson | |
| 5,836,846 | A | | 11/1998 | Hewko | |
| 5,865,091 | A | | 2/1999 | Domanski | |
| 5,867,991 | A | | 2/1999 | Jalink | |
| 5,873,250 | A | | 2/1999 | Lewis | |
| 5,924,305 | A | | 7/1999 | Hill | |
| 5,938,207 | A | | 8/1999 | Marchionna | |
| 5,944,499 | A | | 8/1999 | Morita | |
| 6,030,195 | A | | 2/2000 | Pingston | |
| 6,195,992 | B1 | | 3/2001 | Nommensen | |

OTHER PUBLICATIONS

Walker G, Stirling Engines, Clarendon Press Oxford 1980 pp. 106–123.

Norbye, Jan P., the Wankel Engine: Design Development Applications Bailey Bros & Swinfen Ltd. Folkestone, UK 1972 pp. 4–5, 22–25, 70–71, 86–107, 192–215, 267–289, 168–469, 478–483, 490–503, 485–489.

Lee, Stuart M., Handbook of Composite Reinforcements, (VCH Publishers New York, NY 1993) pp. 41–45, 199, 215–223.

Whelan, T., Polymer Technology Dictionary (Chapman & Hall 1994) pp. 62–63, 148–149, 186–187, 324–325.

* cited by examiner

PLANETARY ROTARY MACHINE USING APERTURES, VOLUTES AND CONTINUOUS CARBON FIBER REINFORCED PEEK SEALS

CONTINUATION DATA

This is a continuation-in-part of Provisional Appl. No. 60/221,263 filed Jul. 27, 2000 and of a provisional application of this same name filed on the same day this application is filed.

BACKGROUND

1. Field of the Invention

This invention relates to rotary machines utilizing planetary motion to either pump fluid or be driven by fluid or accomplish both simultaneously.

2. Description of the Related Art

The fundamental starting point for this invention is the motion of the Wankel type engine. Technically such an engine is a planetary motion machine, which one inventor characterized as: "a rotating piston arrangement where a motor is guided by a gear mechanism meshing with a toothed reaction wheel in such a way that the rotor can move into or out of one or more consecutively following work chambers which accommodate rotor and are in a stationary casing." F. Jernaes, U.S. Pat. No. 3,221,664, Dec. 7, 1965.

A planetary motion machine offers the benefit of fewer moving parts than a typical machine using cyclical motion, valves, or conversion from rotary to linear motion or vice versa to exert or receive pressure. A planetary motion machine may be a pump (that is taking in a fluid stream and compressing it to be exhausted at higher pressure), or a turbine (utilizing pressure to drive a rotor circularly to a lower pressure exhaust, and generating rotary mechanical power in a rotating shaft). A planetary motion machine has less eccentric motion than a typical straight piston machine. It has fewer moving parts in part because the machine is inherently a rotary machine and need not convert linear motion to rotary motion. Its disadvantages are that traditionally the classic planetary motion machine has only one compression per rotor cycle, and at high speed, there can be problems maintaining a seal of the compression chambers.

Figure 2:
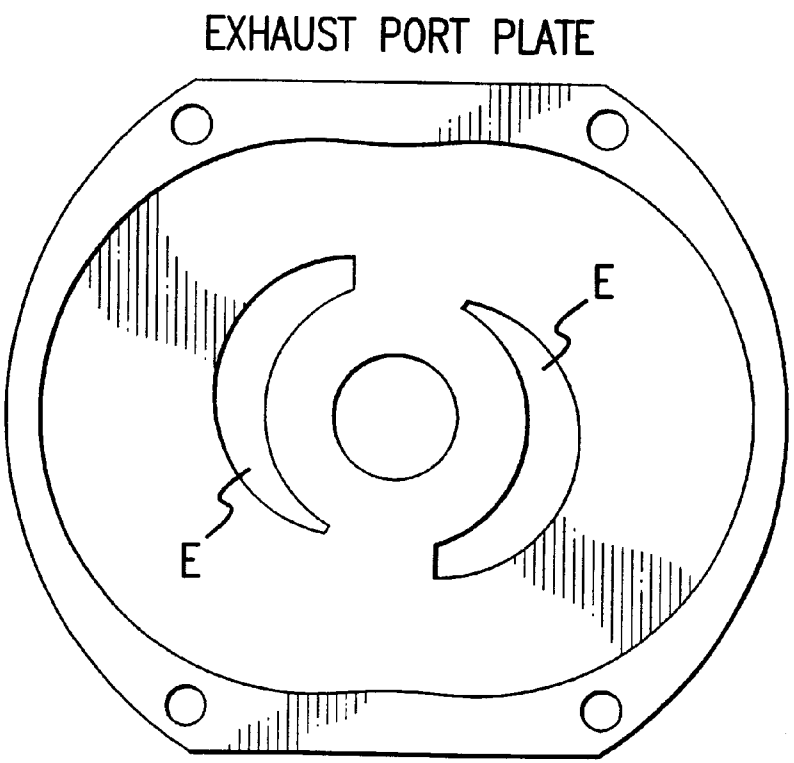
Figure 2:
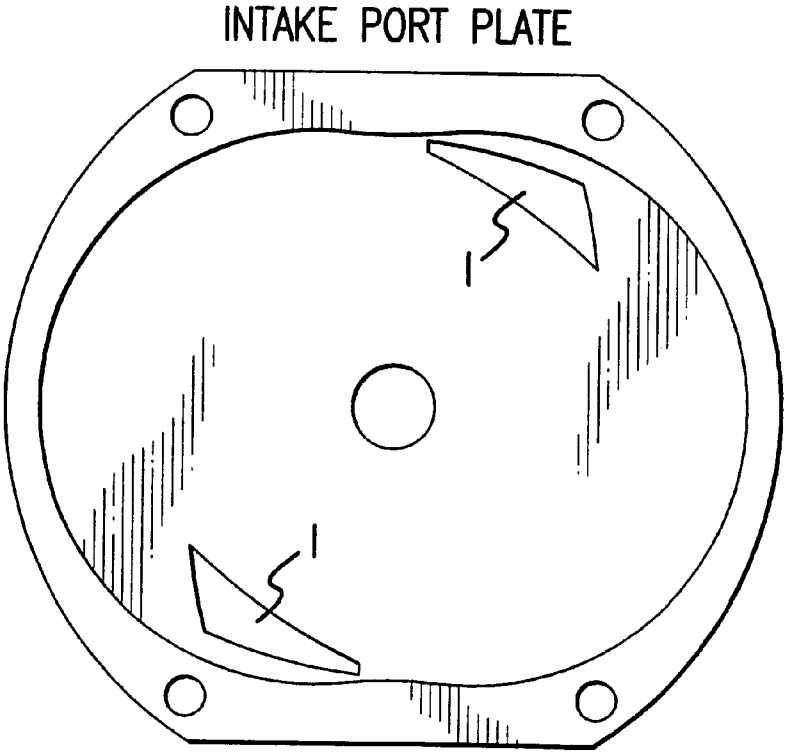

A classic planetary motion machine is illustrated in FIG. 2. The basic shape of the chamber, looking at the chamber from the "top" parallel to the axis of the rotating parts, is that of a symmetric peanut, though the "waist" of the peanut is barely narrowed. The peanut shape is called a peritrochoid in mathematics. The rotor looks like an equilateral triangle with symmetric bulged sides. In essence, the rotor, to use a layperson's description, rolls around in the inside of the peanut with each apex in contact with the peanut. If an engine is placed on the drive shaft of the planetary machine, it will cause the rotor to spin, and the action of an alternating increase and decrease in volumes of the working chambers in combination with alternate occlusion and exposure to intake and exhaust ports will cause fluid to be pumped. Alternatively, if pressurized fluid is allowed into a chamber to force the rotor to turn, then the drive shaft will be forced to rotate and will produce mechanical power at the shaft. Similarly, if pressurized fluid is allowed into a chamber to force the rotor to turn, by changing the position of the intake and exhaust ports for a different chamber, that different chamber can be used to compress fluid, effectively permitting the rotary machine to be a compressor and turbine simultaneously. The fluid can be liquid or gas or a combination.

In order to make a planetary machine attractive, scientists have sought to have more than one chamber simultaneously performing compression/exhaustion while another chamber performs induction/expansion during each rotation of the rotor, and at the same time minimize the number of moving parts, and minimize the speed of what parts are moving. The machine in the present invention is a double pumping or double action planetary machine, meaning that for each planetary cycle, the machine can have one chamber perform a function of compression/exhaust or intake/expansion, while another chamber performs another function of either compression/exhaust or intake/expansion, and therefore the cycle of at least one chamber consists of a) two motions of intake/compression/exhaust, b) two motions of intake/expansion/exhaust or c) one action of each of intake/compression/exhaust and intake/expansion/exhaust.

In 1976, Whitestone, U.S. Pat. No. 3,998,054, Dec. 21, 1976, was issued a patent for a "Rotary Mechanism with Improved Volume Displacement Characteristics." While claiming improved displacement characteristics, and using ports in side plates, his rotor did not use the device of a duct through the rotor face and thence to a side port, nor did his pump contemplate a two-lobe peritrochoidal cavity. The effect of not using this duct or aperture through the rotor face and the lack of two-lobe peritrochoidal cavity is that for any given planetary cycle, the pump fails to achieve the swept volume and compression ratio (maximum volume to minimum volume) that the present invention achieves. This can be seen by reviewing FIGS. 1 through 8 in Whitestone '054. The advantage of the present invention is that a working chamber is nearly totally evacuated from a maximum volume. In Whitestone, particularly as the geometry of his proposed rotor veered away from the three lobed rotor in a square cavity in FIG. 2, Whitestone's invention faces one of two efficiency difficulties. First, there is a large permanently retained minimum volume 25f as in FIG. 9E, which minimizes the compression ratio of the maximum to minimum volume. Alternatively, second, there is a relatively small maximum volume with a somewhat smaller but substantial minimum volume 12af as in subfigures CF and DF of FIG. 13, but no port available for exhaust in Whitestone's '054 invention. Whitestone's porting, shown in Whitestone '054 FIG. 9a, which is the identical rotor position to Whitestone '054 subfigure CF of FIG. 13, particularly for a solid rotor which eliminates volume 25f of FIG. 9E, shows the traditional geometric difficulty faced by Maillard, United Kingdom (British) Pat. No. 583,035 issued Jan. 2, 1947, and prior art rotary pumps of either a) maximizing intake volume for the beginning of compression, but also enlarging the volume being compressed at time of exhaust, as in Whitestone '054, or b) lessening intake volume for the beginning of volume, and lessening the volume being compressed at time of exhaust. An example of the latter is Maillard UK Pat. 583,035 and Juge, U.S. Pat. No. 3,869,863, Mar. 11, 1975.

A rotary pump was proposed in an unpublished project proposal at the University of Calgary, Alberta, Canada referred to as a Zwiauer-Wankel configuration of rotary Stirling engine, for which a figure is shown at p. 79 of G. Walker, Stirling Engines, Clarendon Press, Oxford 1980, Library of Congress Call No. TJ765.W35, and is described at p. 115 of that book, Walker, Stirling Engines. In G. Walker, et al, The Stirling Alternative: Power Systems, Refrigerants and Heat Pumps, p.78, (Gordon and Breach Science Publishers 1994), the same author remarks that the Zwaiuer-Stirling rotary engine is an "arrangement [that] could provide a compact high specific output machine but although proposed over 20 years ago it has not been reduced to practice so far as is known." From the drawing, Zwaiuer appeared to use a solid rotor form with porting after the fashion of Maillard or Whitestone '054, and in any event did not contemplate the use of a duct through the rotor and corresponding porting arrangement.

There are several other planetary machines which do not achieve double action where ducts through the rotor are contemplated, and/or where the maximum to minimum volume (the compression ratio) is not particularly useful for efficient fluid flow, and/or there are sealing problems. However, no art utilizes a system set out in this invention involving ducting, porting and the relative position of the rotor, duct and ports for the basic pumping or turbine action of the planetary machine to achieve double action with a superior volumetric efficiency without seal loss, double action in a three vaned-two lobed pump meaning two compressions and two expansions of fluid per planetary cycle. Maillard, United Kingdom (British) Pat. No. 583,035 issued Jan. 2, 1947, recognized the geometric constraints of his design, but absent a fluid passage through the rotor and proper design of ports and proper location of such a fluid passage, he could not overcome the geometric constraints. The present invention successfully hurdles the geometric constraints and achieves double action which none of the prior art has achieved, and with a minimization of moving parts. See, for example, ducts through the rotor, but no double action: Child, U.S. Pat. No. 4,986,739, Jan. 22, 1991, White, Jr., U.S. Pat. No. 4,872,819, Oct. 10, 1989, Nakayama, U.S. Pat. No. 4,345,886; ducts for lubrication or cooling: Miles, U.S. Pat. No. 4,097,205, Jun. 27, 1978, Nakayama, U.S. Pat. No. 4,345,886, Aug. 24, 1982 (using retractable vanes in the housing).

One of the best uses of this particular invention is as a pump powering an aircraft gyroscope. Non-electric gyroscopes are powered by an air stream that expands through a small turbine that drives the gyroscope. Failure of the pump interrupts the flow of air and causes the gyro to slow down and tumble. Slow or tumbling gyros will deliver incorrect navigational information. A typical pump using sliding vanes made of carbon graphite is seen in Kaatz, U.S. Pat. No. 3,191,852, Jun. 29, 1965, and Bishop, U.S. Pat. No. 5,181,844, Jan. 26, 1993, U.S. Pat. No. 4,820,140.

Apex seals may be kept in close contact with a roughly orthogonal surface using centrifugal force as seen in Kaatz, U.S. Pat. No. 3,191,852, Jun. 29, 1965, and Bishop, U.S. Pat. No. 5,181,844, Jan. 26, 1993, U.S. Pat. No. 4,820,140, or using a technique of feeding pressured air in behind the vanes as seen in Smart et al, U.S. Pat. No. 4,804,313, Feb. 14, 1989. Springs can also be used.

Optimum self-lubricating materials can be seen in any number of patents using polytetraflouroethylene (PTFE), or better yet using carbon fiber reinforced polyetheretherketone (PEEK), particularly continuous carbon fiber reinforced PEEK. Other materials usable as self-lubricating materials are set out in Davies et al, U.S. Pat. No. 5,750,620, May 12, 1998.

The term continuous carbon fiber reinforced PEEK is focused on polyetheretherketone, and a close material cousin PEKK, polyetherketoneketone, but the term includes a compound selected from the group of polyaromatic compounds having amorphous crystal structure corresponding in intermolecular distance to the intermolecular distance of continuous carbon graphite crystal structure such that upon melting of said polyaromatic compound having amorphous crystal structure in the presence of continuous fiber carbon graphite, said combination results in carbon crystal lattice reinforcement of said polyaromatic compound.

OBJECTS OF THIS INVENTION

This invention has three major features yielding improved performance.

First, the creation of a duct through the rotor to the curved face—that is, diagonally from the side of the rotor through the rotor to the curved face of the rotor—yields, in combination with carefully arranged ports, double pumping action and enhanced inlet or exhaust porting. By proper arrangement of the location of the inlet parts, duct and exhaust parts, no new moving parts are introduced beyond the classic rotary machine design, yet a double action pump is created with substantially improved compression ratio. If pressured air is delivered to the invention with a differential lower pressure on the "opposite" side of the pump, a double pumping turbine yielding power to a drive shaft results with a favorable compression ratio.

Second, the planetary machine's performance is enhanced by the use of modem self-lubricating plastics to achieve better sealing.

Third, the use of a volute, in conjunction with the port(s). A volute is a spiraled air pipe that improves the intake and outflow characteristics when collecting and delivering air to the working volumes of the planetary pump. The volute reduces losses caused by turbulence at sharp corners, elbows, etc. and losses caused by sudden expansion.

The invention achieves a variety of objectives by this design. The invention can be a pump when an engine or other rotating device is connected to the machine and causes the rotor to rotate, forcing fluid through the parts of the machine. One preferred use is a vacuum air pump with the drive shaft driven by an airplane engine causing the rotor to turn, which draws air through a gyroscope.

The invention may be a turbine when pressurized fluid drives the machine, or an engine when combustible mixture is ignited in the working chambers. The invention will be described in terms of a pump, understanding the claims are no limited to a pump and that if, a pressure differential between the intake and exhaust side of the pump exists, the machine will function as a turbine.

DESCRIPTION OF THE PREFERRED EMBODIMENT

The general characteristic of the preferred embodiment is somewhat like a two rotor NSU—Wankel internal combustion engine found in some automobiles and aircraft except that the preferred embodiment of the invention disclosed herein is in the form of a mechanically driven pump which delivers air to or from air-driven gyroscopic attitude instruments for piston engine powered aircraft. The pump is composed of a forward stationary side plate with mounting fixture, a two-lobe peanut-shaped peritrochoid stator shroud within which rotates a three-face triangular-shaped rotor, a port plate with intake and exhaust orifices, a volute for ducting the air to and from the external pump connections and the working volumes, a second port plate, stator and rotor combination, followed by a rear stationary side plate. The entire unit is held together by four symmetrically placed bolts.

The center of each cam is displaced eccentrically from the center of the driving shaft. Each cam rotates within a hole machined into the center of each rotor and drives, in the preferred embodiment, continuous carbon fiber reinforced PEEK bearings fit into each rotor, which action in turn causes rotor rotation as later described.

While reference is made to PEEK in the preferred embodiment, PEKK (polyetherketoneketone) has similar properties. More broadly, the invention preferably utilizes for either the bearings and/or or the rotor apex tips as described a compound selected from the group of polyaromatic compounds having amorphous crystal structure corresponding in intermolecular distance to the intermolecular distance of continuous carbon graphite crystal structure such that upon melting of said polyaromatic compound having amorphous crystal structure in the presence of continuous fiber carbon graphite, said combination results in carbon crystal lattice reinforcement of said polyaromatic compound. Enhancements to strength and lubrosity occur upon curing, including curing under pressure. Such compound, including PEEK and PEKK, achieving carbon crystal lattice reinforcement in such manner will be referred to a continuous carbon fiber reinforced polyaromatic compound. Even more broadly, the continuous carbon fiber reinforced polyaromatic compounds, as defined, and those elastomer reinforced polymeric compositions referenced in Davies, U.S. Pat. No. 5,750,620, will be referred to collectively as carbon fiber reinforced polymeric compositions. Materials such as scintered bronze impregnated with PTFE along with carbon fiber reinforced polymeric compositions, or even hydrocarbons in certain applications, will be the broadest category of suitable materials and will collectively be called self-lubricating materials. All of these may be used, but the optimum selection for use is a continuous carbon fiber reinforced polyaromatic compound such as continuous carbon fiber reinforced PEEK.

The preferred embodiment of each rotor has three apices, and therefore three faces corresponding to the number of apices. Each set of two adjacent apices and the intervening face can be referred to generically as a lobe and will have a working chamber of varying volume opposite that lobe which will be moving rotationally and varying volume simultaneously. The rotor is composed of hardened aluminum, e.g., 6061-T6 and machined to the desired contour of three triangularly placed arcs. Each of the three faces of said rotor is penetrated by one of the important innovations of the claimed invention: namely a single duct machined or molded through the rotor face which pierces the side of the rotor which is orthogonal to the face. The duct then forms an aperture through which air flows undisturbed when both ends are not obstructed. The rotor also contains an annular timing gear affixed to either side. This annular gear meshes with a stationary sun or spur gear fixed to the non-rotating forward and rear side plates of the pump and constrains the rotor motion to the desired planetary cycle, much like the Wankel design (The gears could be replaced by a guide similar to Grey's invention U.S. Pat. No. 3,884, 600, May 20, 1975.

In the preferred mode, each apex of the rotor is machined with a groove to accept an apex seal. The apex seal is a rectangular strip composed of a self-lubricating continuous carbon fiber reinforced PEEK material. The apex seal can be pressed against the shroud by way of compression springs. The spring constant and the amount of compression are chosen such that the mechanical properties of the PEEK apex seals are not exceeded. The apex seal forms a zero clearance sliding contact point with the stationary peritrochoid shroud which guarantees that each working volume defined by each rotor face operates independently with minimal exchange of air. The apex seal can be pressed alternatively or additionally against the shroud by means of compressed air fed in behind the apex seal in the manner suggested by Smart, U.S. Pat. No. 4,616,985, Oct. 14, 1986, again such a way that the mechanical properties of the PEEK apex seals are not exceeded. Smart proposes that air be fed in behind the sliding vanes in his pump for purpose of equalizing pressure.

The peritrochoid shrouds are made of hardened aluminum like 6061-T6, preferably with hard-coat anodizing, and with the next-described side plates form the cavity within which each rotor rotates. The peritrochoid shroud and rotor lie between two side plates, either of which may be ported, but for purposes of the best mode, one of which is a port plate and the other an unported side plate. There can be two port plates as an alternative. The side plates are disposed in conjunction with the shroud such that the side plates are in sliding contact with the rotor. The side plates on which are disposed the stationary sun gears are also made of aluminum and mate with the peritrochoidal shrouds. The side plates could be made of or coated with a self-lubricating material such as PEEK, particularly where there is relatively high speed relative motion between the side plates and the rotor. The side housing could be of PEEK, but this is a less desirable equivalent than the vanes being made of PEEK which are much smaller, and the side housing not being made of PEEK. The sun gears, peritrochoidal shrouds, annular gears and rotors are specifically oriented such the planetary motion of the rotor apices is exactly contained by the shroud. To maintain low friction, the side plates, including the port plate(s) can be made from continuous carbon fiber reinforced PEEK similar to the apex seal material. In this way, all sliding surface contacts use low friction self-lubricating material.

Opposite and parallel to the side plates are the port plates which contain two intake ports symmetrically placed about the central axis coincident with the driving shaft and the shroud longitudinal center line and two exhaust ports also symmetrically placed about the central axis. The intake and exhaust ports are of sufficient cross sectional area that the air flow will not choke (reach Mach 1) during normal operation which would reduce performance. The position of the ports is determined to maximize the flow rate performance but generally, in a pump where the fluid will be exhausted from a working chamber and out through a duct in the rotor face to an exhaust port in the side plate, the intake port on a side plate is positioned and configured in such a way that:

a) the intake port is covered by the rotor side at all times except between the "intake port open" and the "intake port closed" rotor position at which time there exists an unobstructed path for air to flow from the intake volute to the working volume formed by the shroud, the side plates, and the rotor face exposed to the intake port. The ports in this configuration are located inside the outer bound of the rotor, but outside the innermost trace of the face of rotor during the rotation cycle.
b) the "intake port open" rotor position is that rotor position where the working volume is near its minimum and the exhaust port is closed or occluded.
c) the "intake port closed" rotor position is that rotor position where the working volume is near its maximum and the exhaust port is closed or occluded.

The exhaust port is positioned and configured in such a way that:

a) the exhaust port is covered by the rotor side at all times.
b) between the "exhaust port open" and "exhaust port closed" rotor position, the exhaust port is aligned with the rotor side aperture formed by the claimed invention of a duct piercing the rotor face previously exposed to the intake port. The alignment is such that an unobstructed path is formed for air to flow from the working volume to the exhaust volute and subsequently out of the device entirely.

c) the "exhaust port open" rotor position is a position after the working volume is near its maximum and the intake port is closed, and some contraction of the working volume has occurred so that the desired pressure is created.

d) the "exhaust port closed" rotor position is that where the working volume is near its minimum.

With respect to the mounting of a volute, each port plate covers one side of the volute. Each side of the volute contains two scroll-like channels which direct air to the two intake ports and from the two exhaust ports. Each volute channel provides an unobstructed, smooth conduit from the ports to the external connections of the pump. The volute is machined from aluminum and also contains a centrally located longitudinal hole through which the driving shaft rotates. The driving shaft can be supported here too by means of a self-lubricating bearing fit into the volute piece.

The actual operation of the pump as a fluid movement device begins with the main driving shaft rotating the rotor and a particular rotor face towards the "intake port open" position. The intake port is uncovered by the rotor side exposing the minimum working volume and a trailing rotor face to the intake volute. The rotor rotation produces an expanding volume which in turn produces a lower-than-inlet pressure which pulls air into the working volume through the intake volute. Air ceases to flow into working volume as the intake port is occluded by the rotor side prior to the working chamber volume contraction due to rotor rotation. As rotor rotation continues, the air is compressed in a now fully enclosed working chamber until the "exhaust port open" position when a clear path forms from the working volume to the exhaust port via the duct from the rotor face to the rotor side. Air continues to flow out of the contracting volume through the duct and into the exhaust volute until the "exhaust port closed" position is reached. This sequence also occurs in the second lobe of the peritrochoid shroud, albeit out of phase. Since the apex seals and side plates produce nearly zero clearance or actually zero clearance, there is little flow communication between the two lobes. Thus, with the claimed invention of an aperture or duct through the rotor face, the intake and exhaust ports can be utilized or be occluded based on maximizing volumetric efficiency rather than observing the geometric constraints found in the Maillard, United Kingdom Pat No. 583,035, Jan. 2, 1947 and Schwab, U.S. Pat. No. 4,551,073, Nov. 5, 1985 designs.

The intake ports, instead of being in the side plates, could be in the shroud, but the volumetric efficiency of the machine is significantly less.

For a turbine, there is no need to wait to create access to the exhaust port until after a period of contraction of a particular working chamber. The turbine can accept fluid to an expanding chamber immediately after minimal volume is achieved, cease accepting fluid to that chamber at maximum volume or in desired quantity, and have the chamber commence access to an exhaust port after an intake port is occluded, and after maximum volume has been achieved. Exhaustion of a chamber can continue until just before an apical tip is at a position where minimal volume is achieved.

The system can be a two rotor system which is statically balanced, and/or counterweights or cams may be added for dynamic balance. These counterweights can be fixed to the driving shaft beyond the forward and rear side plates. Multiple rotor combinations can be used to avoid large counterweights.

If the invention is to have each lobe have a separate exhaust stream, then each lobe must have its own separate exhaust duct and port; the above description of porting locations applies for each chamber, but to separate the exhaust streams, there must be more planning of the relative location of the exhaust ducts. Each duct must intersect the rotor side on a separate peritrochoidal track so that a particular duct only vents to a particular track. If a volute is desired, a volute for each duct and its corresponding track must be created.

There is no requirement in the invention that the duct through the rotor face be used for exhaust. The construct of the planetary machine may be inverted. The intake ports may be designed to be covered by the rotor side at all times, and located to be alternately exposed to an intake duct from the rotor side to the rotor face to a working chamber, with the exhaust ports alternately exposed to the working chamber when the intake ports are not exposed to the duct to the working chamber.

As a turbine, the invention has superior wear properties as a result of the continuous carbon fiber reinforced PEEK used.

Intake and exhaust ducts may be used carry fluid to or from intake and exhaust ports, rather than having ports opening during parts of the cycle directly to a working chamber. In this mode of invention, all ports will then be located inside the innermost trace in each chamber of the face of the rotating rotor.

If the lobes have their own separate exhaust duct and ports from each other, as suggested in the prior paragraph, the exhaust streams are separated, and if in the same way as the exhaust streams were separated the intake streams are separated, then the rotary machine can be set up by appropriate porting to be a pump and turbine, meaning one working chamber is pumping (intake from lower pressure and exhaust at higher pressure), while another is acting as a turbine (intake from higher pressure and exhaust at lower pressure). In essence, the pumping side will have an early close of intake in the rotor face motion for the working chamber acting as a pump and later opening and closing of exhaust, while the turbine side will have a relatively later close of intake in the rotor face motion for the working chamber acting as a turbine and later opening and closing of exhaust. More likely, the separation of the exhaust streams are separated, and, the intake streams are separated, there can be independent inputs and outputs for each respective working volume for specialized applications.

Alternatively, the intake and exhaust ports for one chamber can each have their own fluid source and exhaust outlet, and the intake and exhaust ports for an opposite chamber can each have their own fluid source and exhaust outlet. In that instance, one "side" or chamber can be acting as a compressor, with the other side acting as a turbine using the same previously-described principles for locating ports to achieve these effects.

Description of the Rotor Shape

The equations which describe the shape of the peritrochoid and the faces of the rotor are well developed in the open literature, Kenichi Yamamoto, Rotary Engine, Sankaido Co. Ltd. ($1^{st}$ ed. 1981), therefore only the results as they pertain to this embodiment are presented. The shape of the peritrochoid can be represented in orthogonal coordinates x and y by:

$$x=e\cos a+R\cos(a/3)$$

$$y=e\sin a+R\sin(a/3)$$

where a is the position angle of the main driving shaft and generates periodic motion every 1080 degrees of driving shaft rotation, e is the eccentricity, meaning the amount the rotor axis is displaced from the driving axis, and R is the radius of the rotor, meaning the distance from the rotor axis to the rotor apex.

The outer bounds of the shape of each rotor face in the preferred embodiment of a three lobe rotor can be represented by:

$$x = R\sin 2\theta + \frac{3e^2}{R}\sin 6\theta\cos 2\theta - D\cos 3\theta\sin 2\theta$$

$$y = R\cos 2\theta + \frac{3e^2}{R}\sin 6\theta\sin 2\theta - D\cos 3\theta\cos 2\theta$$

where the further variable D is found by the following equation as θ varies from −30 to +30 degrees for each face and θ is rotated in such range symmetrically about the rotor axis:

$$D = 2e\sqrt{1 - \left[\frac{3e\sin(3\theta)}{R}\right]^2}$$

As the eccentricity e, in the limit, approaches zero, the three faces become closer to being arcs of a circle connecting the apices; however, the ideal compression ratio declines. The machine can also have three lobes.

DESCRIPTION OF FIGURES AND INVENTION

A generic rotor with the features of the present invention utilized as a pump is presented in FIG. 1. The letter "A" denominates the depiction of the aperture through the rotor with its entrance on the rotor face "B," and the aperture's exit on the rotor side opposite to the point indicated by the letter "D" in this embodiment of the invention. The letter "C" indicates the journal bearing hole into which an eccentric drive shaft (normally made eccentric by a cam) is placed which provides power to the rotor. The letter "E" is the annular timing gear which meshes with a stationary sun gear attached to a side plate and guarantees the planetary motion within the peritrochoid.

FIG. 2 illustrates the locations of the typical intake ports and exhaust ports within the peritrochoid shape. For the ducting as shown in the figures, where exhaust is through the duct through the rotor and then to the exhaust ports E, and intake is directly through intake ports I into the working chambers, the intake ports must at least intermittently be within the outer bounds of the trace of the rotor face, and at least intermittently outside the interior trace of the rotor face. The exhaust ports are always within the inner bounds of the trace of the rotor face, and the exhaust duct through the rotor face is intermittently exposed to the exhaust ports in this embodiment.

Figure 3:
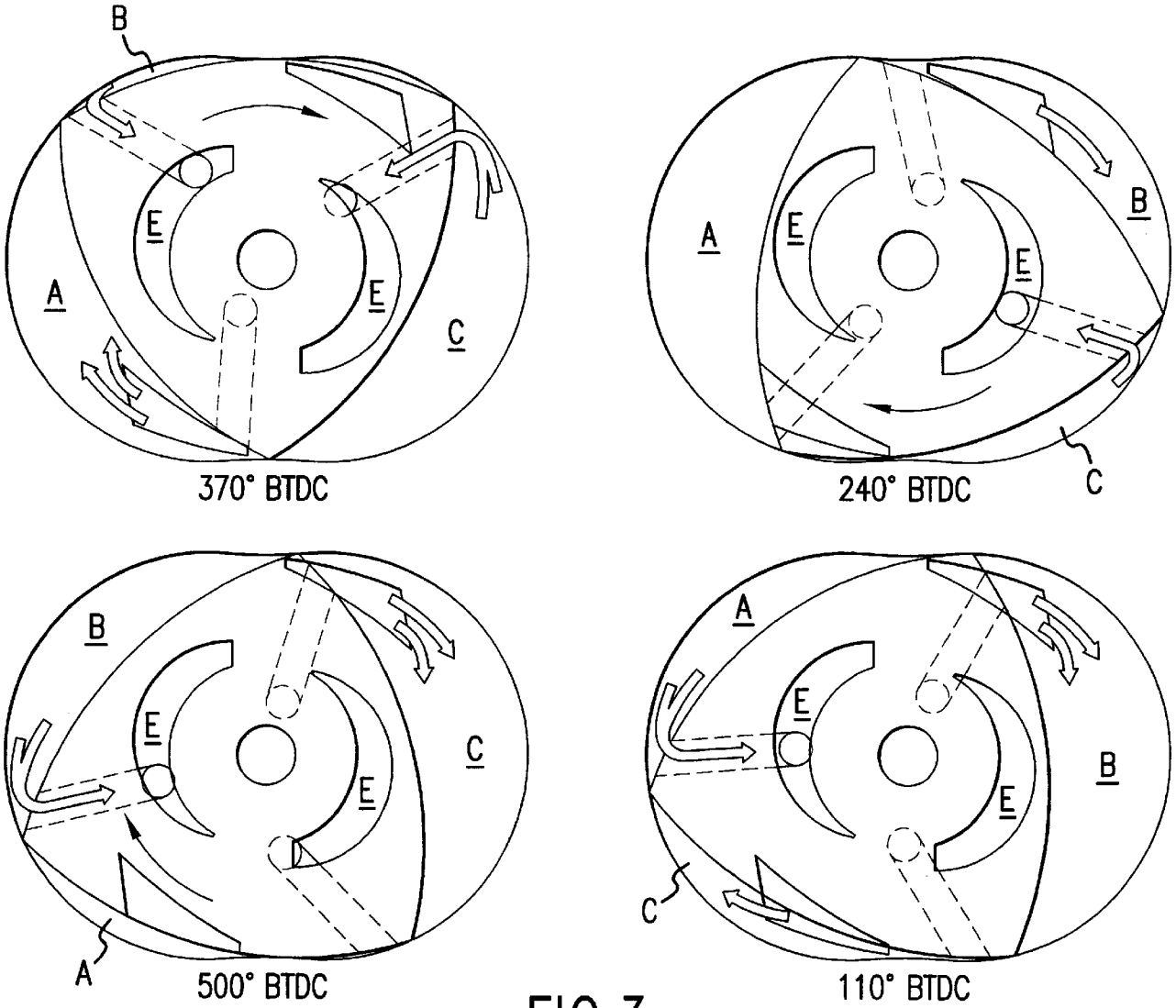

FIG. 3 displays four positions of the rotor with the intake and exhaust ports and the manifold of apertures (three) overlaid. At a driving shaft position of 500 degrees Before-Top-Dead-Center (BTDC), working volume A, which is defined by the housing and rotor face A, is beginning the intake stroke as the intake port I is just starting to be uncovered. The exhaust duct adjacent to the rotor face corresponding to working volume A is not juxtaposed to the exhaust port so as working volume A expands, fluid will be admitted at the ambient pressure at the intake port. Meanwhile, working volume B is in the midst of a compression and exhaust stroke as a clear path exists from volume B to the exhaust port E via the aperture and duct through the rotor. Volumes A and B are sealed from each other by a zero clearance apex seal and the rotor being placed sealingly adjacent to the side plate of the pump. Also, volume C is completing its intake stroke as the working volume is near maximum and intake port I is beginning to be occluded as the rotor side slides over it.

At 370 degree BTDC, working volume A is midway through its intake stroke. The working volume B is completing its compression and exhaust stroke. Working volume C is just beginning its compression stroke with the exhaust port just beginning to be exposed to the exhaust duct through the rotor.

At 240 degrees BTDC, working volume A is near maximum volume and the intake port is now blocked by the rotor side. Working volume B is still expanding and the rotor side has just begun to close off the intake port adjacent to rotor face adjacent to working volume B while working volume C is nearing its minimum volume point. The invention allows the designer to guarantee that the exhaust port is not open while the intake port is open so timing can be completely optimized for maximum performance.

After nearly one drive shaft revolution and one third of a rotor revolution, at 110 degrees BTDC, working volume A is midway through its compression and exhaust stroke. The intake port is almost occluded by the rotor side as to working volume B while the exhaust port is not yet exposed to working chamber B. The rotor side adjacent to working volume C is just uncovering the intake port and the expanding volume admits air from the intake volute.

Description of the Volute

Figure 4:
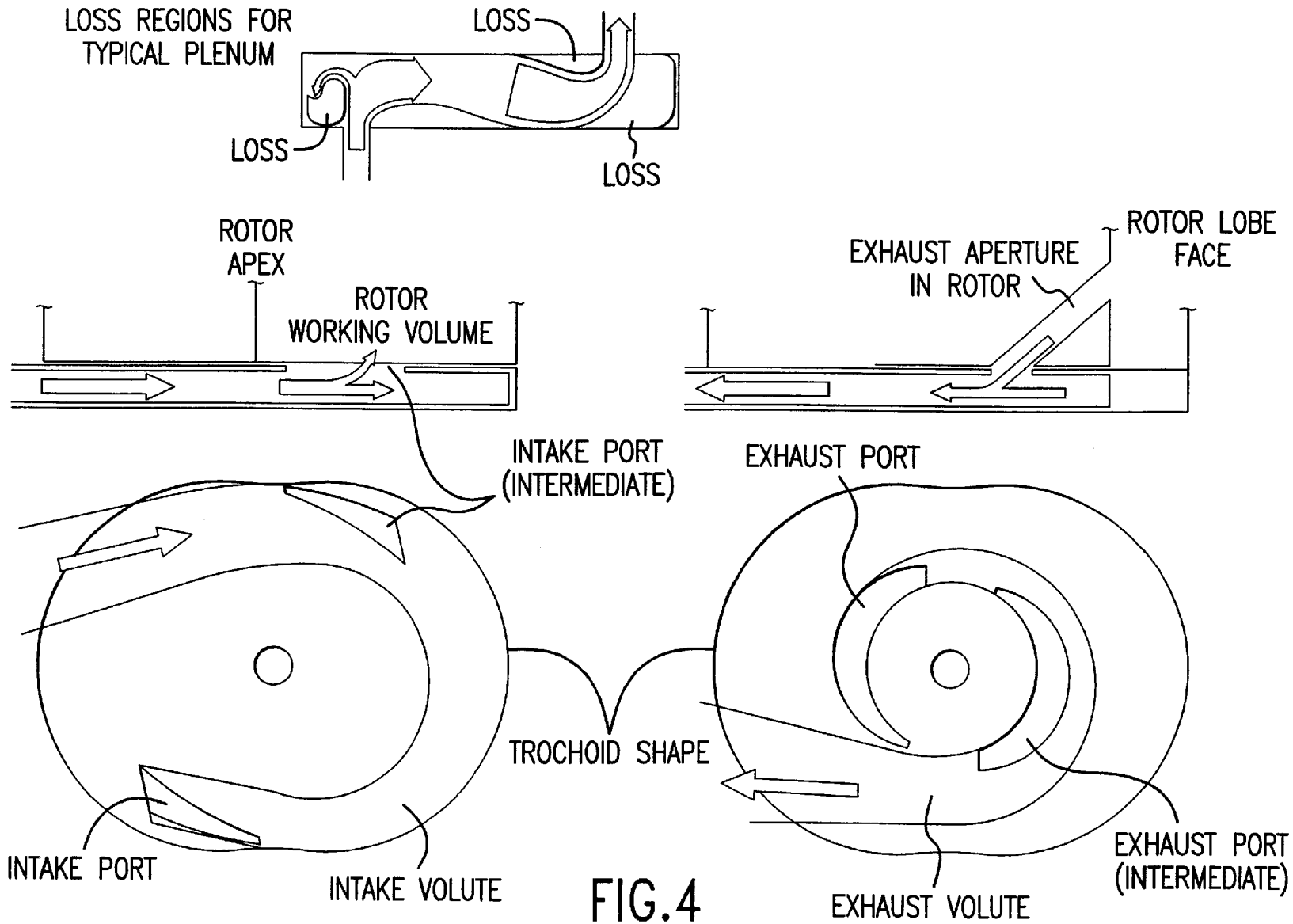

FIG. 4, in the top half, displays a simple representation of the separated flow, with its potential for large fluid dynamic loss encountered in a poorly designed plenum. The largest loss occurs as high speed flow from the working volumes of the pump diffuses rapidly to a nearly quiescent state within a plenum. This high loss flow is then accelerated into the external connection of the pump increasing the loss further. In addition, a large degree of turning over a short distance produces a large loss when streamlines turn away from the mainstream in a diffusing action. By smoothly varying the direction of the air flow and the cross sectional area of the flow passage, these loss mechanisms can be effectively attenuated. A passage with these properties will appear as a scroll-like volute channel.

In the preferred embodiment, shown in the bottom half of FIG. 4, the exhaust volute starts with a cross sectional area which is equal to the area of the aperture cut through the rotor face and is smoothly varied to the area of the conduit which carries the fluid from the pump unit. The rate at which the cross sectional area varies is set below a critical value where fluid dynamic energy loss from diffusion increases rapidly. The alignment of the exhaust volute is coincident with the alignment of the aperture when the exhaust port is open and turns to parallel to the exiting conduit. By maintaining proper alignment, the exiting air will not need to turn sharply thereby promoting smooth flow with a commensurate reduction in pressure loss and secondary flow action.

Similarly, the intake volute starts with a cross sectional area equal to the conduit delivering fluid to the pump unit and generally parallel to the conduit's alignment. The end of the volute is then aligned with the peritrochoid surface and its cross-section is smoothly varied to a value of equal to the intake port area. The rate of cross sectional area change is less significant than the exhaust volute since the air flow is generally accelerating into the working volume and accelerating air is less susceptible to the deleterious effects of viscosity.

Figure 5:
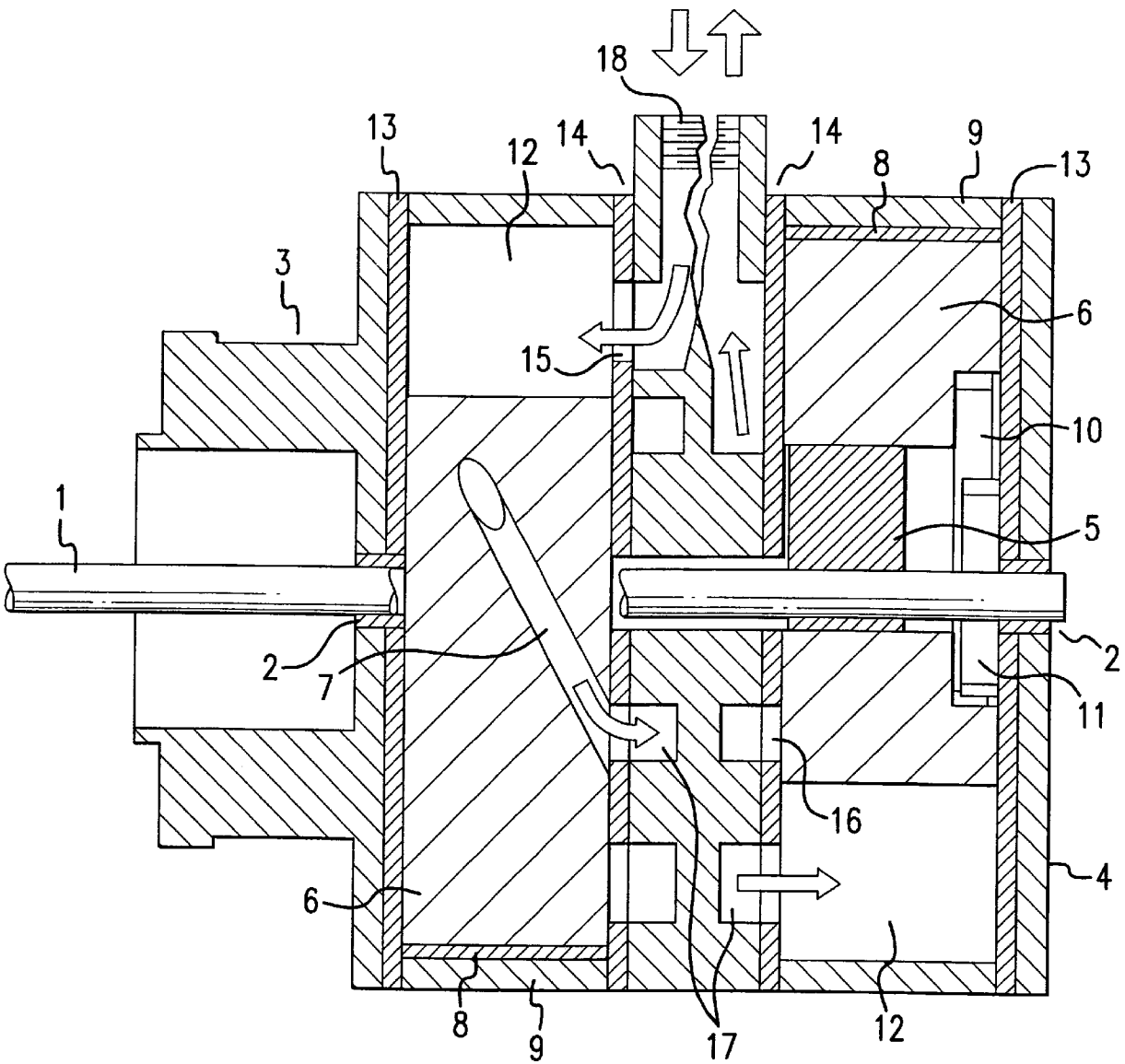

FIG. 5 shows a cross section along the line of the driving shaft.

Description of the Mechanical Parts

A description of the interrelationship of the parts is as follows referring to the numbers in FIG. 5: The driving shaft (1) transmits the mechanical power from an engine to the pump. The shaft is supported by at least two bearings (2) composed of any self-lubricating material such as PEEK or PTFE or scintered bronze impregnated with lubricant. The bearings are set in the side plate (4). Fixed to the driving shaft are two cams (5) which ride inside continuous carbon reinforced PEEK bearings fit into each rotor and which drive the rotor rotation. Each rotor (6) has three-lobes with the claimed invention of an aperture (7) connecting each rotor face with the rotor side. Each apex of each rotor contains the claimed invention of an apex seal composed of continuous carbon fiber reinforced PEEK (8). The apex seals are in sliding contact with a two-lobe peritrochoid shroud (9) and forced against the shroud by means of small compression springs. The planetary motion of the rotor is maintained by an annular gear (10) fixed to each rotor by means of screws or pins and a stationary sun gear (11) fixed to the side plate by means of screws. The working volumes of the pump (12) are then formed by the rotor face and the side plates composed of continuous carbon fiber reinforced PEEK (13) and (14). The inner-most side plates (14) contain the intake and exhaust ports (15) and (16), respectively. The intake and exhaust ports expose portions of the claimed invention of intake and exhaust volutes (17) which deliver and collect air from the working volumes to and from the separate intake and exhaust external pump connections (18). The entire unit is held together by means of bolts symmetrically placed about the driving shaft and parallel to it.

The external connections of the invention pump mate with threaded pipe connectors which are attached to flexible hoses. These hoses are connected to filters, regulators, and other devices used in fluid transfer and flow.

If used on an aircraft, such hoses would be ultimately attached to the gyroscopic instruments fixed to the aircraft. One added benefit of the preferred embodiment is that, in using low friction, high flexural strength continuous carbon fiber reinforced PEEK seals and side plates, the potential for catastrophic failure of the unit is minimized. The likely failure mode is a detectable, graceful degradation which perceptive pilots will recognize early as a small pressure drop across the gyroscopic instruments indicating low flow rate. Early recognition will lead to replacement of the pump prior to ultimate failure and loss of function of the gyroscopic instruments.

For use on an aircraft, most piston engines for aircraft include an accessory drive which provides power to a spline receptacle on the accessory case. The spline receptacle accepts the spline end of the main driving shaft of the pump and would be the sole means of powering the aircraft device. The main driving shaft of the pump is normally supported by two self-lubricating bearings fit into the forward and rear stationary components of the pump. Attached to the main driving shaft are two cams of circular cross section which are diametrically opposed, which correspond to the earlier described cams which are eccentrically displaced from the center of the driving shaft.

The invention has other advantages as a result of the thermodynamic and kinetic effects of the fluid being handled and the arrangement and shape of the ports. The ports may be varied to avoid, or to encourage "choking", where fluid speed has reached Mach 1, and to smooth or vary the characteristics of fluid flow through the machine. Those reasonably skilled in the art will recognize that because of kinetic and thermodynamic effects, there are alternate modes available for operation, and while the working chamber is expanding, there could in fact be a short interval of compression, and conversely, while the working chamber is contracting, there could in fact be a short interval of expansion. The invention does not link the entire compression phase with contraction of the working chamber, nor does the invention link the entire expansion phase with increase in volume of the working chamber. Rather, three fluid action phases are referred to. The arbitrarily selected first phase is the expansion phase which would include an intake phase and a compression phase which would include an exhaust phase, and an interphase at which there would be no intake or exhaust. However, there may be fluid expansion even while there is no intake, or while the working chamber is contracting. Similarly, there may be fluid contraction even while there is no exhaust or while the working chamber is expanding.

Also contemplated are ducts through the rotor that enable fluid pressure to be applied behind sliding apical tips or springs behind sliding apical tips if greater pressure of the apical tips against the side housing is desired.

Another mode of the invention particularly useful where it is important to separate fluid streams flowing through the planetary machine uses independently "tracked" exhaust and intake ducts for each vane face. By placing the ports for intake ducts inside the trace of innermost peritrochoidal trace made by the vane face, including the edge of the vane face having the apical seal, and outside the outermost trace of the annular gear and cam mechanism so proper sealing is maintained, and by placing the ports for exhaust ducts inside the trace of innermost peritrochoidal trace made by the vane face, including the edge of the vane face having the apical seal, and by using peritrochoidal track segments to enable continuous or at least virtually continuous porting of the ports to separate plena at the desired portions of the cycle, the pump yields a novel feature of double pumping of three separate streams of fluid. While all ports could be on one side of the rotor and the six tracks can be fit to correspond to the intake and exhaust porting arrangement, it is easier to have one side be the intake side and the other the exhaust side.

The demonstration of the mechanics of the air flow in a Stirling cycle can be described as follows: for a first vane face, starting when the face has a minimal working chamber volume, which we will designate as top dead center (TDC), as the chamber expands, fluid flows in from intake duct 1 which flows to the working chamber corresponding to the first vane face. When the chamber is fully expanded, the side of the rotor obstructs further flow from the intake track into the duct into that working chamber. However, at that point a second vane face will correspond to a working chamber of minimal volume which will be exposed to this or another intake track enabling repetition of the just described first portion of the cycle.

Returning to the first vane face, depending on the compression desired, the chamber can be foreclosed from the intake or exhaust duct for that face communicating with any ambient fluid. After selected compression, if any, the exhaust duct can communicate with the exhaust track corresponding to the exhaust port, and as the chamber contracts to minimal volume, the fluid inside the working chamber corresponding to the first vane face is exhausted. On exhaust, the second face, will be ready to turn again to the compression and exhaust phases.

The invention as described is particularly useful for external combustion engines, including Stirling and Ericsson cycle engines, because the planetary pump converts heat energy to rotational work in a simple mechanism in the expansion phase of the working chamber. The volumetric characteristics of this planetary machine are such that combined with a tandem and like machine, the machines cooperating together can have a corresponding working chamber working in tandem such that the sum of the volumes of working chamber 1 in the first machine plus an arbitrarily selected working chamber 1 in the second machine can be set to be a virtual constant. The invention also enables effective sealing because of the PEEK and more precise machining and cam function the lack of which effective parts has been the traditional impediment to utilizing a planetary machine for an external combustion cycle machine.

A side plate in a sense has a groove for each track with the grooves being "open" to the ports at the necessary times of the cycle. There are times when the intake port for a particular chamber obviously cannot and is not needed to communicate with the intake plena, such as when the chamber is compressing or exhausting fluid.

The embodiments represented herein are only a few of the many embodiments and modifications that a practitioner reasonably skilled in the art could make or use. The invention is not limited to these embodiments nor to the versions encompassed in the figure which is intended as an aid to understanding the invention and is not meant to limit the disclosure or the claims. Alternative embodiments and modifications which would still be encompassed by the invention may be made by those skilled in the art, particularly in light of the foregoing teachings. Therefore, the following claims are intended to cover any alternative embodiments, modifications or equivalents which may be included within the spirit and scope of the invention as claimed.

We claim:

1. An improved double action planetary motion machine having a rotor rotating in a planetary motion cycle having a number n of apices, n being equal to at least three, and having a central rotor axis, said n apices being arrayed symmetrically around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and each said working chamber being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, the improvement comprising:

said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

at least one exhaust duct penetrating each one of said n rotor faces of said rotating rotor, said exhaust duct being formed by an exhaust duct aperture in said rotor in order to allow fluid to pass through said rotor;

each said at least one exhaust duct penetrating through each one of said n rotor faces, through said rotor and through one of said rotor sides;

rotor exhaust ports defined by each said exhaust duct aperture in each said rotor side;

at least one of said side plates having at least m housing exhaust ports, m being equal to at least two, each said m housing exhaust port being an aperture in at least one of said side plates adjacent to each said at least one rotor side having rotor exhaust ports and being disposed around said central cavity axis to allow passage of fluid out of said working chambers from said exhaust duct apertures during portions of said planetary rotation cycle;

said m housing exhaust ports being disposed peritrochoidally around said central cavity axis and being disposed to cooperate intermittently with each said rotor exhaust port to allow the passage of fluid from each said one of said p working chambers to at least one of said m housing exhaust ports through said at least one exhaust duct and through said rotor exhaust port during an exhaust phase of said each one working chamber;

each said housing exhaust port disposed peritrochoidally being truncated to permit said side plate to intermittently obstruct fluid from flowing out of said rotor exhaust ports during said planetary rotation cycle and to permit said rotor to intermittently obstruct fluid from flowing out of said p working chambers, and further being truncated and disposed to permit said rotor side to intermittently obstruct fluid from flowing out of said p working chambers during said compression phase of at least one of said p working chambers;

at least one of said side plates having at least q housing intake ports, q being equal to at least two, each said q housing intake port being an aperture in at least one of said side plates adjacent to each said at least one rotor side and being disposed peritrochoidally around said central cavity axis to allow passage of fluid into said working chambers during said intake phase of each of at least one of said p working chambers during said planetary rotation cycle;

each said housing intake port disposed peritrochoidally being truncated and disposed to permit said rotor side to intermittently obstruct fluid from flowing into said p working chambers during a compression phase and exhaust phase of at least one of said p working chambers;

each said rotor exhaust port, each said housing exhaust port, and each said housing intake port being further disposed to cooperate intermittently with said rotating rotor to intake fluid during part of said planetary rotation cycle into at least one of said at least p working chambers if said exhaust duct into said at least one working chamber is not juxtaposed to a housing exhaust port, if said exhaust port for said working chamber is occluded by said rotor side, and if said working chamber is juxtaposed to an intake port;

said housing intake ports, said rotor exhaust ports, and said housing exhaust ports being disposed to cooperate with said rotor side so that during said intake phase for each of said p working chambers, said rotor side does not block said housing intake port for said each working chamber, and said rotor exhaust port is not juxtaposed to said housing exhaust port for said each working chamber;

said housing intake ports, said rotor exhaust ports and said housing exhaust ports being disposed to cooperate with said rotor so that during said interphase for each of said p working chambers, said rotor side occludes said housing intake port and said exhaust port for said each working chamber, and said rotor exhaust port for each said one of said p working chambers continues to not be juxtaposed to a housing port;

said housing intake ports, said rotor exhaust ports, and said housing exhaust ports being disposed to cooperate with said rotor said so that during said exhaust phase for each of said p working chambers, said rotor side continues to occlude said housing intake port, and said rotor exhaust port for each said one of said p working chambers is juxtaposed to a housing exhaust port;

said housing intake ports, said rotor exhaust ports, and said housing exhaust ports being disposed to cooperate with said rotor said so that during said exhaust phase for each of said p working chambers, said rotor side occludes said housing intake port, said rotor exhaust port is juxtaposed to said housing exhaust port and fluid in said one of said p working chambers is exhausted through said exhaust duct aperture, said rotor exhaust port, and said housing exhaust port;

said housing intake ports, said rotor exhaust ports, and said housing exhaust ports being disposed to cooperate with said rotor so that for one planetary cycle of said rotor, a double action planetary machine results for each said lobe.

2. The planetary motion machine according to claim 1, further comprising:

said apices having radial apical sealing slots;

said radial apical sealing slots having apical seals made of self-lubricating material.

3. The planetary motion machine according to claim 2, further comprising:

ducts through said rotor having outlets behind said apical seals to enable pressure from a working chamber to be applied to said apical seal toward said side housing.

4. The planetary motion machine according to claim 2, further comprising:

springs in said sealing slots and behind said apical seals to enable pressure to be applied to said apical seal toward said side housing.

5. The planetary motion machine according to claim 2, further comprising:

said apical seals made of self-lubricating material being made of continuous carbon fiber reinforced PEEK.

6. The planetary motion machine according to claim 5, further comprising:

ducts through said rotor having outlets behind said apical seals to enable pressure from a working chamber to be applied to said apical seal toward said side housing.

7. The planetary motion machine according to claim 5, further comprising:

springs in said sealing slots and behind said apical seals to enable pressure to be applied to said apical seal toward said side housing.

8. The planetary motion machine according to claim 1, further comprising:

said apices having apical seal tips made of continuous carbon fiber reinforced PEEK.

9. The planetary motion machine according to claim 1, further comprising:

said side plates having at least surfaces in relative motion to any other surface made of continuous carbon fiber reinforced PEEK.

10. The planetary motion machine according to claim 1, further comprising:

each of said side plates having said ports disposed to a least one volute for at least one of said ports for streamlining fluid flow.

11. The planetary motion machine according to claim 10, further comprising:

said side plates having said ports further having a plenum to serve at least one port.

12. The planetary motion machine according to claim 1, further comprising:

said mechanical rotational linkage between said rotating driving means and said rotor rotating in a planetary motion cycle utilizing a circular cam, said cam being eccentrically fixed to said driving shaft, a journal bearing; and said planetary motion machine having a means for maintaining timing between said rotating driving means and said rotating rotor.

13. The planetary motion machine according to claim 12, further comprising:

said means for maintaining timing being an annular gear being embedded in said rotor, a sun gear fixed to at least one side plate, and said means for maintaining timing having an integer gear tooth ratio between said annular gear and said sun gear equal to the number of apices n divided by said number of lobes.

14. The planetary motion machine according to claim 12, further comprising:

said journal bearing being made of continuous carbon fiber reinforced PEEK.

15. The planetary motion machine according to claim 12, further comprising:

said mechanical rotational linkage having a pin mounted on said rotor, sliding in a peritrochoidal track on at least one of said side plates.

16. An improved double action planetary motion machine having a rotating rotor having a number n of apices, n being equal to at least three, and having a central rotor axis, said n apices being arrayed symmetrically around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and each said working chamber being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, the improvement comprising:

said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

at least one intake duct penetrating each one of said n rotor faces of said rotating rotor, said intake duct being formed by an intake duct aperture in said rotor in order to allow fluid to pass through said rotor;

each said at least one intake duct penetrating through each one of said n rotor faces, through said rotor and through one of said rotor sides;

rotor intake ports defined by each said intake duct aperture in each said rotor side;

at least one of said side plates having at least r housing intake ports, r being equal to at least two, each said r housing intake port being an aperture in at least one of said side plates adjacent to each said at least one rotor side having rotor intake ports and being disposed around said central cavity axis to allow passage of fluid into said working chambers from said intake duct apertures during portions of said planetary rotation cycle;

said r housing intake ports being disposed peritrochoidally around said central cavity axis and being disposed to cooperate intermittently with each said rotor intake port to allow the passage of fluid into each said one of said p working chambers from at least one of said m housing intake ports through said at least one intake duct and through said rotor intake port during an intake phase of said each one working chamber;

each said housing intake port disposed peritrochoidally being truncated to permit said side plates to intermittently obstruct fluid from flowing into said rotor intake ports during said planetary rotation cycle and to intermittently obstruct fluid from flowing into said p working chambers, and further being truncated and disposed to permit said rotor side to intermittently obstruct fluid from flowing into said p working chambers during said compression phase of at least one of said p working chambers;

at least one of said side plates having at least s housing exhaust ports, s being equal to at least two, each said s housing exhaust port being an aperture in at least one of said side plates adjacent to each said at least one rotor side and being disposed peritrochoidally around said central cavity axis to allow passage of fluid out of said working chambers during said exhaust phase of each of at least one of said p working chambers during said planetary rotation cycle;

each said housing exhaust port, each said rotor intake port, and each said housing intake port being truncated and disposed to permit said rotor side to intermittently obstruct fluid from flowing out of said p working chambers during an intake phase and compression phase of at least one of said p working chambers;

each said housing exhaust port disposed peritrochoidally being further disposed to cooperate intermittently with said rotating rotor to exhaust fluid during part of said planetary rotation cycle from at least one of said at least p working chambers if said rotor intake duct into said at least one working chamber is not juxtaposed to a housing intake port, if compression of fluid has occurred, if said intake port for said working chamber is occluded by said rotor side, and if said working chamber is juxtaposed to a housing exhaust port;

said housing intake ports, said rotor intake ports, and said housing exhaust ports being disposed to cooperate with said rotor said so that during said exhaust phase for each of said p working chambers, said rotor side does not occlude said housing exhaust port for said each working chamber, and said rotor intake port is not juxtaposed to said housing intake port for said each working chamber;

said housing intake ports, said rotor exhaust ports and said housing exhaust ports being disposed to cooperate with said rotor so that during said interphase for each of said p working chambers, said rotor side occludes said housing exhaust port and said intake port for said each working chamber, and said rotor intake port for each said one of said p working chambers continues to not be juxtaposed to a housing port;

said housing intake ports, said rotor intake ports, and said housing exhaust ports being disposed to cooperate with said rotor side so that during said intake phase for each of said p working chambers, said rotor side continues to occlude said housing exhaust port, and said rotor intake port for each said one of said p working chambers is juxtaposed to a housing intake port;

said housing intake ports, said rotor intake ports, and said housing exhaust ports being disposed to cooperate with said rotor so that during said intake phase for each of said p working chambers, said rotor side occludes said housing exhaust port, said rotor intake port is juxtaposed to said housing intake port and fluid is said one of said p working chambers is drawn through said intake duct aperture, said rotor intake port, and said housing intake port;

said housing intake ports, said rotor exhaust ports, and said housing exhaust ports being disposed to cooperate with said rotor so that for one planetary cycle of said rotor, a double action planetary machine results for each said lobe.

17. The planetary motion machine according to claim 16, further comprising:

said apices having radial apical sealing slots;

said radial apical sealing slots having apical seals made of self-lubricating material.

18. The planetary motion machine according to claim 17, further comprising:

ducts through said rotor having outlets behind said apical seals to enable pressure from a working chamber to be applied to said apical seal toward said side housing.

19. The planetary motion machine according to claim 17, further comprising:

springs in said sealing slots and behind said apical seals to enable pressure to be applied to said apical seal toward said side housing.

20. The planetary motion machine according to claim 17, further comprising:

said apical seals made of self-lubricating material being made of continuous carbon fiber reinforced PEEK.

21. The planetary motion machine according to claim 20, further comprising:

ducts through said rotor having outlets behind said apical seals to enable pressure from a working chamber to be applied to said apical seal toward said side housing.

22. The planetary motion machine according to claim 20, further comprising:

springs in said sealing slots and behind said apical seals to enable pressure to be applied to said apical seal toward said side housing.

23. The planetary motion machine according to claim 16, further comprising:

said apices having apical seal tips made of continuous carbon fiber reinforced PEEK.

24. The planetary motion machine according to claim 16, further comprising:

said side plates having at least surfaces in relative motion to any other surface made of continuous carbon fiber reinforced PEEK.

25. The planetary motion machine according to claim 16, further comprising:

each of said side plates having said ports disposed to a least one volute for at least one of said ports for streamlining fluid flow.

26. The planetary motion machine according to claim 25, further comprising:

said side plates having said ports further having a plenum to serve at least one port.

27. The planetary motion machine according to claim 16, further comprising:

said mechanical rotational linkage between said rotating driving means and said rotor rotating in a planetary motion cycle utilizing a circular cam, said cam being eccentrically fixed to said driving shaft, a journal bearing; and said planetary motion machine having a means for maintaining timing between said rotating driving means and said rotating rotor.

28. The planetary motion machine according to claim 27, further comprising:

said means for maintaining timing being an annular gear being embedded in said rotor, a sun gear fixed to at least one side plate, and said means for maintaining timing having an integer gear tooth ratio between said annular gear and said sun gear equal to the number of apices n divided by said number of lobes.

29. The planetary motion machine according to claim 27, further comprising:

said journal bearing being made of continuous carbon fiber reinforced PEEK.

30. The planetary motion machine according to claim 27, further comprising:

said mechanical rotational linkage having a pin mounted on said rotor, sliding in a peritrochoidal track on at least one of said side plates.

31. An improved double action planetary motion machine having a rotor rotating in a planetary motion cycle having a number n of apices, n being equal to at least three, and having a central rotor axis, said n apices being arrayed symmetrically around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and each said working chamber being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, the improvement comprising:

said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

at least one exhaust duct penetrating each one of said n rotor faces of said rotating rotor, said exhaust duct being formed by an exhaust duct aperture in said rotor in order to allow fluid to pass through said rotor;

each said at least one exhaust duct penetrating through each one of said n rotor faces, through said rotor and through one of said rotor sides;

rotor exhaust ports defined by each said exhaust duct aperture in each said rotor side;

at least one of said side plates having at least m housing exhaust ports, m being equal to at least two, each said m housing exhaust port being an aperture in at least one of said side plates adjacent to each said at least one rotor side having rotor exhaust ports and being disposed around said central cavity axis to allow passage of fluid out of said working chambers from said exhaust duct apertures during portions of said planetary rotation cycle;

said m housing exhaust ports being disposed peritrochoidally around said central cavity axis and being disposed to cooperate intermittently with each said rotor exhaust port to allow the passage of fluid from each said one of said p working chambers to at least one of said m housing exhaust ports through said at least one exhaust duct and through said rotor exhaust port during an exhaust phase of said each one working chamber;

each said housing exhaust port disposed peritrochoidally being truncated to permit said side plate to intermittently obstruct fluid from flowing out of said rotor exhaust ports during said planetary rotation cycle and to permit said rotor to intermittently obstruct fluid from flowing out of said p working chambers, and further being truncated and disposed to permit said rotor side to intermittently obstruct fluid from flowing out of said p working chambers during said compression phase of at least one of said p working chambers;

at least one intake duct penetrating each one of said n rotor faces of said rotating rotor, said intake duct being formed by an intake duct aperture in said rotor in order to allow fluid to pass through said rotor;

each said at least one intake duct penetrating through each one of said n rotor faces, through said rotor and through one of said rotor sides;

rotor intake ports defined by each said intake duct aperture in each said rotor side;

at least one of said side plates having at least r housing intake ports, r being equal to at least two, each said r housing intake port being an aperture in at least one of said side plates adjacent to each said at least one rotor side having rotor intake ports and being disposed around said central cavity axis to allow passage of fluid into said working chambers from said intake duct apertures during portions of said planetary rotation cycle;

said r housing intake ports being disposed peritrochoidally around said central cavity axis and being disposed to cooperate intermittently with each said rotor intake port to allow the passage of fluid into each said one of said p working chambers from at least one of said m housing intake ports through said at least one intake duct and through said rotor intake port during an intake phase of said each one working chamber;

each said housing intake port disposed peritrochoidally being truncated to permit said side plates to intermittently obstruct fluid from flowing into said rotor intake ports during said planetary rotation cycle and to intermittently obstruct fluid from flowing into said p working chambers, and further being truncated and disposed to permit said rotor side to intermittently obstruct fluid from flowing into said p working chambers during said compression phase of at least one of said p working chambers;

each said rotor exhaust port, each said rotor intake port, each said housing exhaust port, and each said housing intake port being further disposed to cooperate intermittently with said rotating rotor to intake fluid during part of said planetary rotation cycle into at least one of said at least p working chambers if said exhaust duct into said at least one working chamber is not juxtaposed to a housing exhaust port, if said exhaust port for said working chamber is occluded by said rotor side, and if said rotor intake port for said working chamber is juxtaposed to an intake port;

said housing intake ports, said rotor intake ports, said rotor exhaust ports, and said housing exhaust ports being disposed to cooperate with said rotor side so that during said intake phase for each of said p working chambers, said rotor side does not block said housing intake port for said each working chamber, said rotor intake port for said each working chamber is juxtaposed to an intake port, and said rotor exhaust port for said each working chamber is not juxtaposed to said housing exhaust port for said each working chamber;

said housing intake ports, said rotor intake ports, said rotor exhaust ports and said housing exhaust ports being disposed to cooperate with said rotor so that during said interphase for each of said p working chambers, said rotor side occludes said housing intake port and said exhaust port for said each working chamber, and said rotor exhaust port and said rotor intake port for each said one of said p working chambers continues is not juxtaposed to a housing port;

said housing intake ports, said rotor intake ports, said rotor exhaust ports, and said housing exhaust ports being disposed to cooperate with said rotor said so that during said exhaust phase for each of said p working chambers, said rotor side continues to occlude said housing intake port, said rotor intake port for said each working chamber is not juxtaposed to said housing intake port and said rotor exhaust port for each said one of said p working chambers is juxtaposed to a housing exhaust port;

said housing intake ports, said rotor intake ports, said rotor exhaust ports, and said housing exhaust ports being disposed to cooperate with said rotor said so that during said exhaust phase for each of said p working chambers, said rotor side occludes said housing intake port, said rotor exhaust port is juxtaposed to said housing exhaust port and fluid in said one of said p working chambers is exhausted through said exhaust duct aperture, said rotor exhaust port, and said housing exhaust port;

said housing intake ports, said rotor exhaust ports, and said housing exhaust ports being disposed to cooperate with said rotor so that for one planetary cycle of said rotor, a double action planetary machine results for each said lobe.

32. The planetary motion machine according to claim 31, further comprising:

said apices having radial apical sealing slots;

said radial apical sealing slots having apical seals made of self-lubricating material.

33. The planetary motion machine according to claim 32, further comprising:

ducts through said rotor having outlets behind said apical seals to enable pressure from a working chamber to be applied to said apical seal toward said side housing.

34. The planetary motion machine according to claim 32, further comprising:

springs in said sealing slots and behind said apical seals to enable pressure to be applied to said apical seal toward said side housing.

35. The planetary motion machine according to claim 32, further comprising:

said apical seals made of self-lubricating material being made of continuous carbon fiber reinforced PEEK.

36. The planetary motion machine according to claim 35, further comprising:

ducts through said rotor having outlets behind said apical seals to enable pressure from a working chamber to be applied to said apical seal toward said side housing.

37. The planetary motion machine according to claim 35, further comprising:

springs in said sealing slots and behind said apical seals to enable pressure to be applied to said apical seal toward said side housing.

38. The planetary motion machine according to claim 31, further comprising:

said apices having apical seal tips made of continuous carbon fiber reinforced PEEK.

39. The planetary motion machine according to claim 31, further comprising:

said side plates having at least surfaces in relative motion to any other surface made of continuous carbon fiber reinforced PEEK.

40. The planetary motion machine according to claim 31, further comprising:

each of said side plates having said ports disposed to a least one volute for at least one of said ports for streamlining fluid flow.

41. The planetary motion machine according to claim 40, further comprising:

said side plates having said ports further having a plenum to serve at least one port.

42. The planetary motion machine according to claim 31, further comprising:

said mechanical rotational linkage between said rotating driving means and said rotor rotating in a planetary motion cycle utilizing a circular cam, said cam being eccentrically fixed to said driving shaft, a journal bearing; and said planetary motion machine having a means for maintaining timing between said rotating driving means and said rotating rotor.

43. The planetary motion machine according to claim 42, further comprising:

said means for maintaining timing being an annular gear being embedded in said rotor, a sun gear fixed to at least one side plate, and said means for maintaining timing having an integer gear tooth ratio between said annular gear and said sun gear equal to the number of apices n divided by said number of lobes.

44. The planetary motion machine according to claim 42, further comprising:

said journal bearing being made of continuous carbon fiber reinforced PEEK.

45. The planetary motion machine according to claim 42, further comprising:

said mechanical rotational linkage having a pin mounted on said rotor, sliding in a peritrochoidal track on at least one of said side plates.

46. An improved double action planetary motion machine having a rotor rotating in a planetary motion cycle having a number n of apices, n being equal to at least three, and having a central rotor axis, said n apices being arrayed symmetrically around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and each said working chamber being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, the improvement comprising:

said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

at least one exhaust duct penetrating each one of said n rotor faces of said rotating rotor, said exhaust duct being formed by an exhaust duct aperture in said rotor in order to allow fluid to pass through said rotor;

each said at least one exhaust duct penetrating through each one of said n rotor faces, through said rotor and through one of said rotor sides;

rotor exhaust ports defined by each said exhaust duct aperture in each said rotor side;

at least one of said side plates having at least m housing exhaust ports, m being equal to at least two, each said m housing exhaust port being an aperture in at least one of said side plates adjacent to each said at least one rotor side having rotor exhaust ports and being disposed around said central cavity axis to allow passage of fluid out of said working chambers from said exhaust duct apertures during portions of said planetary rotation cycle;

said m housing exhaust ports being disposed peritrochoidally around said central cavity axis and being disposed to cooperate intermittently with each said rotor exhaust port to allow the passage of fluid from each said one of said p working chambers to at least one of said m housing exhaust ports through said at least one exhaust duct and through said rotor exhaust port during an exhaust phase of said each one working chamber;

each said housing exhaust port disposed peritrochoidally being truncated to permit said side plate to intermittently obstruct fluid from flowing out of said rotor exhaust ports during said planetary rotation cycle and to permit said rotor to intermittently obstruct fluid from flowing out of said p working chambers, and further being truncated and disposed to permit said rotor side to intermittently obstruct fluid from flowing out of said p working chambers during said compression phase of at least one of said p working chambers;

at least one of said side plates having at least q housing intake ports, q being equal to at least two, each said q housing intake port being an aperture in at least one of said side plates adjacent to each said at least one rotor side and being disposed peritrochoidally around said central cavity axis to allow passage of fluid into said working chambers during said intake phase of each of at least one of said p working chambers during said planetary rotation cycle;

each said housing intake port disposed peritrochoidally being truncated and disposed to permit said rotor side to intermittently obstruct fluid from flowing into said p working chambers during a compression phase and exhaust phase of at least one of said p working chambers;

each said rotor exhaust port, each said housing exhaust port, and each said housing intake port being further disposed to cooperate intermittently with said rotating rotor to intake fluid during part of said planetary rotation cycle into at least one of said at least p working chambers if said exhaust duct into said at least one working chamber is not juxtaposed to a housing exhaust port, if said exhaust port for said working chamber is occluded by said rotor side, and if said working chamber is juxtaposed to an intake port;

said housing intake ports, said rotor exhaust ports, and said housing exhaust ports being disposed to cooperate with said rotor side so that during said intake phase for each of said p working chambers, said rotor side does not block said housing intake port for said each working chamber, and said rotor exhaust port is not juxtaposed to said housing exhaust port for said each working chamber;

said housing intake ports, said rotor exhaust ports and said housing exhaust ports being disposed to cooperate with said rotor so that during said interphase for each of said p working chambers, said rotor side occludes said housing intake port and said exhaust port for said each working chamber, and said rotor exhaust port for each said one of said p working chambers continues to not be juxtaposed to a housing port;

said housing intake ports, said rotor exhaust ports, and said housing exhaust ports being disposed to cooperate with said rotor said so that during said exhaust phase for each of said p working chambers, said rotor side continues to occlude said housing intake port, and said rotor exhaust port for each said one of said p working chambers is juxtaposed to a housing exhaust port;

said housing intake ports, said rotor exhaust ports, and said housing exhaust ports being disposed to cooperate with said rotor said so that during said exhaust phase for each of said p working chambers, said rotor side occludes said housing intake port, said rotor exhaust port is juxtaposed to said housing exhaust port and fluid in said one of said p working chambers is exhausted through said exhaust duct aperture, said rotor exhaust port, and said housing exhaust port;

said housing intake ports, said rotor exhaust ports, and said housing exhaust ports being disposed to cooperate with said rotor so that for one planetary cycle of said rotor, a double action planetary machine results for each said lobe;

said apices having radial apical sealing slots;

said radial apical sealing slots having apical seals made of self-lubricating material;

said apical seals made of self-lubricating material being made of continuous carbon fiber reinforced PEEK;

said mechanical rotational linkage between said rotating driving means and said rotor rotating in a planetary motion cycle utilizing a circular cam, said cam being eccentrically fixed to said driving shaft, a journal bearing; and said planetary motion machine having a means for maintaining timing between said rotating driving means and said rotating rotor;

said means for maintaining timing being an annular gear being embedded in said rotor, having a sun gear fixed to at least one side plate, and said means for maintaining timing having an integer gear tooth ratio between said annular gear and said sun gear equal to the number of apices n divided by said number of lobes; and said journal bearing being made of continuous carbon fiber reinforced PEEK.

47. The planetary motion machine according to claim 46, further comprising:

each of said side plates having said ports disposed to a least one volute for at least one of said ports for streamlining fluid flow.

48. The planetary motion machine according to claim 47, further comprising:

said side plates having said ports further having a plenum to serve at least one port.

49. The planetary motion machine according to claim 48, further comprising:

said side plates having at least surfaces in relative motion to any other surface made of continuous carbon fiber reinforced PEEK.

50. An improved double action planetary motion machine having a rotating rotor having a number n of apices, n being equal to at least three, and having a central rotor axis, said n apices being arrayed symmetrically around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and each said working chamber being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, the improvement comprising:

said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

at least one intake duct penetrating each one of said n rotor faces of said rotating rotor, said intake duct being formed by an intake duct aperture in said rotor in order to allow fluid to pass through said rotor;

each said at least one intake duct penetrating through each one of said n rotor faces, through said rotor and through one of said rotor sides;

rotor intake ports defined by each said intake duct aperture in each said rotor side;

at least one of said side plates having at least r housing intake ports, r being equal to at least two, each said r housing intake port being an aperture in at least one of said side plates adjacent to each said at least one rotor side having rotor intake ports and being disposed around said central cavity axis to allow passage of fluid into said working chambers from said intake duct apertures during portions of said planetary rotation cycle;

said r housing intake ports being disposed peritrochoidally around said central cavity axis and being disposed to cooperate intermittently with each said rotor intake port to allow the passage of fluid into each said one of said p working chambers from at least one of said m housing intake ports through said at least one intake duct and through said rotor intake port during an intake phase of said each one working chamber;

each said housing intake port disposed peritrochoidally being truncated to permit said side plates to intermittently obstruct fluid from flowing into said rotor intake ports during said planetary rotation cycle and to intermittently obstruct fluid from flowing into said p working chambers, and further being truncated and disposed to permit said rotor side to intermittently obstruct fluid from flowing into said p working chambers during said compression phase of at least one of said p working chambers;

at least one of said side plates having at least s housing exhaust ports, s being equal to at least two, each said s housing exhaust port being an aperture in at least one of said side plates adjacent to each said at least one rotor side and being disposed peritrochoidally around said central cavity axis to allow passage of fluid out of said working chambers during said exhaust phase of each of at least one of said p working chambers during said planetary rotation cycle;

each said housing exhaust port, each said rotor intake port, and each said housing intake port being truncated and disposed to permit said rotor side to intermittently obstruct fluid from flowing out of said p working chambers during an intake phase and compression phase of at least one of said p working chambers;

each said housing exhaust port disposed peritrochoidally being further disposed to cooperate intermittently with said rotating rotor to exhaust fluid during part of said planetary rotation cycle from at least one of said at least p working chambers if said rotor intake duct into said at least one working chamber is not juxtaposed to a housing intake port, if compression of fluid has occurred, if said intake port for said working chamber is occluded by said rotor side, and if said working chamber is juxtaposed to a housing exhaust port;

said housing intake ports, said rotor intake ports, and said housing exhaust ports being disposed to cooperate with said rotor said so that during said exhaust phase for each of said p working chambers, said rotor side does not occlude said housing exhaust port for said each working chamber, and said rotor intake port is not juxtaposed to said housing intake port for said each working chamber;

said housing intake ports, said rotor exhaust ports and said housing exhaust ports being disposed to cooperate with said rotor so that during said interphase for each of said p working chambers, said rotor side occludes said housing exhaust port and said intake port for said each working chamber, and said rotor intake port for each said one of said p working chambers continues to not be juxtaposed to a housing port;

said housing intake ports, said rotor intake ports, and said housing exhaust ports being disposed to cooperate with said rotor side so that during said intake phase for each of said p working chambers, said rotor side continues to occlude said housing exhaust port, and said rotor intake port for each said one of said p working chambers is juxtaposed to a housing intake port;

said housing intake ports, said rotor intake ports, and said housing exhaust ports being disposed to cooperate with said rotor so that during said intake phase for each of said p working chambers, said rotor side occludes said housing exhaust port, said rotor intake port is juxtaposed to said housing intake port and fluid is said one of said p working chambers is drawn through said intake duct aperture, said rotor intake port, and said housing intake port;

said housing intake ports, said rotor exhaust ports, and said housing exhaust ports being disposed to cooperate with said rotor so that for one planetary cycle of said rotor, a double action planetary machine results for each said lobe;

said apices having radial apical sealing slots;

said radial apical sealing slots having apical seals made of self-lubricating material;

said apical seals made of self-lubricating material being made of continuous carbon fiber reinforced PEEK;

said mechanical rotational linkage between said rotating driving means and said rotor rotating in a planetary motion cycle utilizing a circular cam, said cam being eccentrically fixed to said driving shaft, a journal bearing; and said planetary motion machine having a means for maintaining timing between said rotating driving means and said rotating rotor;

said means for maintaining timing being an annular gear being embedded in said rotor, having a sun gear fixed to at least one side plate, and said means for maintaining timing having an integer gear tooth ratio between said annular gear and said sun gear equal to the number of apices n divided by said number of lobes; and said journal bearing being made of continuous carbon fiber reinforced PEEK.

51. The planetary motion machine according to claim 50, further comprising:

each of said side plates having said ports disposed to a least one volute for at least one of said ports for streamlining fluid flow.

52. The planetary motion machine according to claim 51, further comprising:

said side plates having said ports further having a plenum to serve at least one port.

53. The planetary motion machine according to claim 52, further comprising:

said side plates having at least surfaces in relative motion to any other surface made of continuous carbon fiber reinforced PEEK.

54. An improved double action planetary motion machine having a rotor rotating in a planetary motion cycle having a number n of apices, n being equal to at least three, and having a central rotor axis, said n apices being arrayed symmetrically around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and each said working chamber being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, the improvement comprising:

said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

at least one exhaust duct penetrating each one of said n rotor faces of said rotating rotor, said exhaust duct being formed by an exhaust duct aperture in said rotor in order to allow fluid to pass through said rotor;

each said at least one exhaust duct penetrating through each one of said n rotor faces, through said rotor and through one of said rotor sides;

rotor exhaust ports defined by each said exhaust duct aperture in each said rotor side;

at least one of said side plates having at least m housing exhaust ports, m being equal to at least two, each said m housing exhaust port being an aperture in at least one of said side plates adjacent to each said at least one rotor side having rotor exhaust ports and being disposed around said central cavity axis to allow passage of fluid out of said working chambers from said exhaust duct apertures during portions of said planetary rotation cycle;

said m housing exhaust ports being disposed peritrochoidally around said central cavity axis and being disposed to cooperate intermittently with each said rotor exhaust port to allow the passage of fluid from each said one of said p working chambers to at least one of said m housing exhaust ports through said at least one exhaust duct and through said rotor exhaust port during an exhaust phase of said each one working chamber;

each said housing exhaust port disposed peritrochoidally being truncated to permit said side plate to intermittently obstruct fluid from flowing out of said rotor exhaust ports during said planetary rotation cycle and to permit said rotor to intermittently obstruct fluid from flowing out of said p working chambers, and further being truncated and disposed to permit said rotor side to intermittently obstruct fluid from flowing out of said p working chambers during said compression phase of at least one of said p working chambers;

at least one intake duct penetrating each one of said n rotor faces of said rotating rotor, said intake duct being formed by an intake duct aperture in said rotor in order to allow fluid to pass through said rotor;

each said at least one intake duct penetrating through each one of said n rotor faces, through said rotor and through one of said rotor sides;

rotor intake ports defined by each said intake duct aperture in each said rotor side;

at least one of said side plates having at least r housing intake ports, r being equal to at least two, each said r housing intake port being an aperture in at least one of said side plates adjacent to each said at least one rotor side having rotor intake ports and being disposed around said central cavity axis to allow passage of fluid into said working chambers from said intake duct apertures during portions of said planetary rotation cycle;

said r housing intake ports being disposed peritrochoidally around said central cavity axis and being disposed to cooperate intermittently with each said rotor intake port to allow the passage of fluid into each said one of said p working chambers from at least one of said m housing intake ports through said at least one intake duct and through said rotor intake port during an intake phase of said each one working chamber;

each said housing intake port disposed peritrochoidally being truncated to permit said side plates to intermittently obstruct fluid from flowing into said rotor intake ports during said planetary rotation cycle and to intermittently obstruct fluid from flowing into said p working chambers, and further being truncated and disposed to permit said rotor side to intermittently obstruct fluid from flowing into said p working chambers during said compression phase of at least one of said p working chambers;

each said rotor exhaust port, each said rotor intake port, each said housing exhaust port, and each said housing intake port being further disposed to cooperate intermittently with said rotating rotor to intake fluid during part of said planetary rotation cycle into at least one of said at least p working chambers if said exhaust duct into said at least one working chamber is not juxtaposed to a housing exhaust port, if said exhaust port for said working chamber is occluded by said rotor side, and if said rotor intake port for said working chamber is juxtaposed to an intake port;

said housing intake ports, said rotor intake ports, said rotor exhaust ports, and said housing exhaust ports being disposed to cooperate with said rotor side so that during said intake phase for each of said p working chambers, said rotor side does not block said housing intake port for said each working chamber, said rotor intake port for said each working chamber is juxtaposed to an intake port, and said rotor exhaust port for said each working chamber is not juxtaposed to said housing exhaust port for said each working chamber;

said housing intake ports, said rotor intake ports, said rotor exhaust ports and said housing exhaust ports being disposed to cooperate with said rotor so that during said interphase for each of said p working chambers, said rotor side occludes said housing intake port and said exhaust port for said each working chamber, and said rotor exhaust port and said rotor intake port for each said one of said p working chambers continues is not juxtaposed to a housing port;

said housing intake ports, said rotor intake ports, said rotor exhaust ports, and said housing exhaust ports being disposed to cooperate with said rotor said so that during said exhaust phase for each of said p working chambers, said rotor side continues to occlude said housing intake port, said rotor intake port for said each working chamber is not juxtaposed to said housing intake port and said rotor exhaust port for each said one of said p working chambers is juxtaposed to a housing exhaust port;

said housing intake ports, said rotor intake ports, said rotor exhaust ports, and said housing exhaust ports being disposed to cooperate with said rotor said so that during said exhaust phase for each of said p working chambers, said rotor side occludes said housing intake port, said rotor exhaust port is juxtaposed to said housing exhaust port and fluid in said one of said p working chambers is exhausted through said exhaust duct aperture, said rotor exhaust port, and said housing exhaust port;

said housing intake ports, said rotor exhaust ports, and said housing exhaust ports being disposed to cooperate with said rotor so that for one planetary cycle of said rotor, a double action planetary machine results for each said lobe;

said apices having radial apical sealing slots;

said radial apical sealing slots having apical seals made of self-lubricating material;

said apical seals made of self-lubricating material being made of continuous carbon fiber reinforced PEEK;

said mechanical rotational linkage between said rotating driving means and said rotor rotating in a planetary motion cycle utilizing a circular cam, said cam being eccentrically fixed to said driving shaft, a journal bearing; and said planetary motion machine having a means for maintaining timing between said rotating driving means and said rotating rotor;

said means for maintaining timing being an annular gear being embedded in said rotor, having a sun gear fixed to at least one side plate, and said means for maintaining timing having an integer gear tooth ratio between said annular gear and said sun gear equal to the number of apices n divided by said number of lobes; and said journal bearing being made of continuous carbon fiber reinforced PEEK.

55. The planetary motion machine according to claim 54, further comprising:

each of said side plates having said ports disposed to a least one volute for at least one of said ports for streamlining fluid flow.

56. The planetary motion machine according to claim 55, further comprising:

said side plates having said ports further having a plenum to serve at least one port.

57. The planetary motion machine according to claim 56, further comprising:

said side plates having at least surfaces in relative motion to any other surface made of continuous carbon fiber reinforced PEEK.

58. In a planetary motion machine having a rotating rotor having a number n of apices, n being equal to at least three, and having a central rotor axis, said n apices being arrayed around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

a method of obtaining double action pumping comprising: penetrating each rotor face with at least one duct to permit the passage of fluid from each of said working chambers corresponding with said each rotor face to at least one rotor side; disposing housing exhaust ports to permit passage of fluid out of said machine from each of said working chambers through each said at least one duct corresponding with said each said working chamber during said exhaust phase of said cycle two times during said cycle;

disposing said housing exhaust ports to occlude passage of fluid out of said machine from each said at least one duct during said planetary cycle during said interphase and during said expansion phase;

disposing housing intake ports to occlude passage of fluid out of said machine from said each said working chamber said planetary cycle during said interphase and said compression phase; and disposing housing intake ports to permit passage of fluid into said machine and into each said working chamber during said intake phase of said cycle two times during said cycle.

59. In a planetary motion machine having a rotating rotor having a number n of apices, n being equal to at least three, and having a central rotor axis, said n apices being arrayed around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

a method of obtaining double action pumping comprising:

penetrating each rotor face with at least one duct to permit the passage of fluid from each of said working chambers corresponding with said each rotor face to at least one rotor side;

disposing housing intake ports to occlude passage of fluid out of said machine from said each said working chamber said planetary cycle during said compression phase and said interphase;

disposing said housing intake ports to permit passage of fluid into said machine from each of said working chambers through each said at least one duct corresponding with said each said working chamber during said intake phase of said cycle two times during said cycle;

disposing housing exhaust ports to permit passage of fluid out of said machine from each of said working chambers during said exhaust phase of said cycle two times during said cycle;

disposing said housing exhaust ports to occlude passage of fluid out of said machine from each said at least one duct during said interphase and said expansion phase of said planetary cycle.

60. In a planetary motion machine having a rotating rotor having a number n of apices, n being equal to at least three, and having a central rotor axis, said n apices being arrayed around said central rotor axis;

said rotating rotor having at least n rotor faces, said rotor faces being curved surfaces disposed to connect each said one apex of said n apices to an adjacent apex of each said one of said n apices, said n rotor faces being disposed generally parallel to said central rotor axis;

said rotating rotor having two parallel rotor sides similar in shape and disposed perpendicularly to said central rotor axis;

said planetary motion machine having a mechanical rotational linkage from axial rotation to planetary rotation between an axially rotating driving means and said rotor rotating in a planetary motion cycle;

said planetary motion machine having a machine housing;

said machine housing having a side housing;

said side housing having a peritrochoid cavity interior to said side housing;

said machine housing having two parallel sides disposed perpendicularly to said central rotor axis, said sides being two parallel side plates;

said peritrochoid cavity having cavity sides interior to said machine housing generally parallel to said central rotor axis and said peritrochoid cavity further having at least n−1 lobes and being symmetrically shaped to accommodate said planetary rotation cycle of said rotating rotor;

said side housing having a central cavity axis parallel to said central rotor axis;

said machine housing and said rotating rotor defining an interior space of p working chambers, p being a number equal to n, each said working chamber being inside said peritrochoid cavity and being formed of the volume enclosed by said peritrochoid side housing, said side plates, and one of said rotor faces;

said p working chambers alternately expanding and contracting in size during said planetary rotation cycle as said rotor rotates in planetary motion;

said rotor being disposed inside said housing so that said side plates are juxtaposed sealingly with said rotor faces, said planetary rotation cycle having consecutive fluid action phases for each said working chamber, said consecutive fluid action phases being at least three, said fluid action phases including an expansion phase, an interphase, and a compression phase, said expansion phase including an intake phase, and said compression phase including an exhaust phase;

a method of obtaining double action pumping comprising:

penetrating each rotor face with at least one intake duct and at least one exhaust duct to permit the passage of fluid from each of said working chambers corresponding with said each rotor face to at least one rotor side;

disposing housing exhaust ports to permit passage of fluid out of said machine from each of said working chambers through each said at least one exhaust duct corresponding with said each said working chamber during said exhaust phase of said cycle two times during said cycle;

disposing said housing exhaust ports to occlude passage of fluid out of said machine from each said at least one exhaust duct during said interphase and said expansion phase of said planetary cycle;

disposing housing intake ports to occlude passage of fluid out of said machine from said each said working chamber during said interphase and said compression phase of said planetary cycle; and disposing housing intake ports to permit passage of fluid into said machine from each of said working chambers through each said at least one intake duct corresponding with said each said working chamber during said intake phase of said cycle two times during said cycle.

* * * * *